US007841902B2

(12) United States Patent
Chow et al.

(10) Patent No.: US 7,841,902 B2
(45) **Date of Patent: *Nov. 30, 2010**

(54) ELECTRICAL CONNECTOR SYSTEM WITH MAGNETIC MODULE

(75) Inventors: John Chow, Saratoga, CA (US); Li-Chun Wu, Tu-Cheng (TW); Chao-Tung Huang, Tu-Cheng (TW); Chih-Min Lin, Tu-Cheng (TW); Jie Zhang, Kunshan (CN); Yong-Chun Xu, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

This patent is subject to a terminal disclaimer.

(21) Appl. No.: 12/584,667

(22) Filed: Sep. 9, 2009

(65) Prior Publication Data

US 2010/0062645 A1 Mar. 11, 2010

(30) Foreign Application Priority Data

| | | |
|---|---|---|
| Sep. 9, 2008 | (CN) | 2008 1 0304422 |
| Sep. 10, 2008 | (CN) | 2008 1 0304436 |
| Sep. 10, 2008 | (CN) | 2008 1 0304437 |
| Sep. 10, 2008 | (CN) | 2008 1 0304442 |
| Sep. 10, 2008 | (CN) | 2008 1 0304443 |

(51) Int. Cl.
*H01R 13/66* (2006.01)

(52) U.S. Cl. ..... 439/620.15; 439/676

(58) Field of Classification Search ..... 439/620.06, 439/620.07, 620.15, 941, 79, 676
See application file for complete search history.

(56) References Cited

U.S. PATENT DOCUMENTS

| | | | | |
|---|---|---|---|---|
| 5,926,003 | A * | 7/1999 | Morita | 320/107 |
| 6,806,790 | B2 * | 10/2004 | Ji | 333/119 |
| 6,811,442 | B1 * | 11/2004 | Lien et al. | 439/620.07 |
| 6,835,098 | B1 * | 12/2004 | Chang | 439/620.06 |
| 6,986,684 | B1 * | 1/2006 | Lien | 439/620.07 |
| 7,241,181 | B2 * | 7/2007 | Machado et al. | 439/676 |
| 7,661,994 | B2 * | 2/2010 | Machado et al. | 439/676 |
| 2010/0022133 | A1 * | 1/2010 | Chow et al. | 439/620.15 |
| 2010/0062625 | A1 * | 3/2010 | Chow et al. | 439/79 |
| 2010/0062626 | A1 * | 3/2010 | Chow et al. | 439/79 |

* cited by examiner

*Primary Examiner*—Thanh-Tam T Le
(74) *Attorney, Agent, or Firm*—Ming Chieh Chang; Wei Te Chung; Andrew C. Cheng

(57) ABSTRACT

An electrical connector system includes a substrate (1) connected to PHY side and an electrical connector (3) mounted on the substrate (1), a transformer (5) and a common mode filter (7). The electrical connector (3) is used to mate with a cable assembly and so forms a Cable side. The transformer (5) further includes a first wire (51) having two opposite ends electrically connected to the PHY side and a second wire (53) having two opposite ends. The common mode filter (7) has a third wire (73) and a fourth wire (75) physically separated from the second wire (53). The third wire (73) has an end electrically connected to one end of the second wire (53) and an opposite end electrically connected to the Cable side. The fourth wire (75) has an end electrically connected to the opposite end of the second wire (53) and an opposite end electrically connected to the Cable side.

12 Claims, 32 Drawing Sheets

ELECTRICAL CONNECTOR SYSTEM WITH MAGNETIC MODULE

CROSS-REFERENCE TO RELATED APPLICATIONS

This patent application is related to the following pending U.S. patent applications assigned to the same assignee with this application: application Ser. No. 12/319,299, filed on Jan. 5, 2008, published in on Jul. 9, 2009 and entitled "ELECTRICAL CONNECTOR HAVING AN IMPROVED MAGNETIC MODULE"; application Ser. No. 12/321,470, filed on Jan. 20, 2009, published in on Jul. 23, 2009 and entitled "ELECTRICAL CONNECTOR WITH MAGNETIC MODULE"; and application Ser. No. 12/508,792, filed on Jul. 24, 2009, and entitled "ELECTRICAL CONNECTOR WITH MAGNETIC MODULE".

BACKGROUND OF THE INVENTION

1. Field of the Invention

The present invention relates to an electrical connector system, and more particularly, to an electrical connector system having magnetic module for noise-filter.

2. Description of the Prior Art

Magnetic elements, including transformer and common mode filter, are often used to filter noises in high-speed communication. An electrical connector system having magnetic modules with more effective noise filtering, smaller size and lower cost is always a focus of the designers of the field.

SUMMARY OF THE INVENTION

A main object of the present invention is to provide an electrical connector system having transformer and common mode filter which is convenient to be manufactured and assembled.

The present invention provides an electrical connector system used for a network interface, said network interface providing signal (communication) channels between a first side and a second side. The electrical connector system comprises a substrate forming a plurality of conductive traces, an electrical connector mounted on the substrate; a transformer having a first wire having two opposite ends electrically connected to said first side and a second wire having two opposite ends, a common mode filter having a third wire and a fourth wire that are physically separated from the second wire, wherein the third wire has an end electrically connected to one end of the second wire and an opposite end electrical connected to said second side, and wherein the fourth wire has an end electrically connected to the opposite end of the second wire and an opposite end electrical connected to said second side. The transformer further has a magnetic core defining two holes parallel extending therethrough and forming a center wall between the two holes. The wires of the transformer wind around the center wall and get through said two holes.

According one aspect of the present invention, the second wire and the third wire and the fourth wire are physically separated from each other, so that the transformer and the common mode filter could be independently manufactured and conveniently assembled.

BRIEF DESCRIPTION OF THE DRAWINGS

The features of this invention, which are believed to be novel, are set fourth with particularity in the appended claims.

The invention, together with its objects and the advantages thereof, may be best understood by reference to the following description taken in conjunction with the accompanying drawings, in which like reference numerals identify like elements in the figures and in which.

DETAILED DESCRIPTION OF THE PREFERRED EMBODIMENTS OF THE INVENTION

Figure 1:
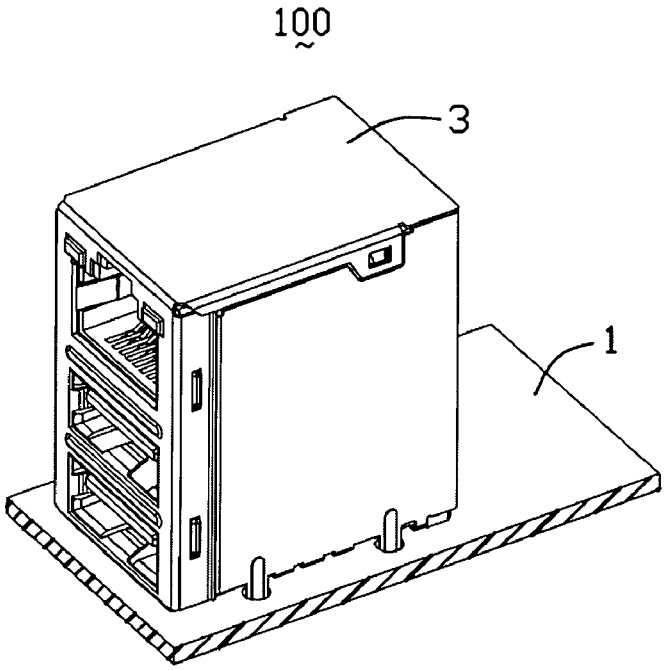
FIG. 1 is a perspective view of an electrical connector system according to a first design.

Reference will now be made to the drawing figures to describe the present invention in detail.

FIGS. 1-12D show four electrical connector systems embodying a similar principle to the present invention, which has been disclosed in U.S. application Ser. No. 12/508,792, filed on Jul. 24, 2009, and entitled "ELECTRICAL CONNECTOR WITH MAGNETIC MODULE". The electrical connector systems are used for a network interface operating under 10/100 based Ethernet. The network interface provides signal (communication) channels (referring to FIGS. 12A-12D) between a PHY side and a Cable side.

Referring to FIGS. 1-3 and 12A-12C, the electrical connector system according to a first design is shown. The electrical connector system comprises a substrate 1 forming a plurality of conductive traces connected to PHY side, an electrical connector 3 mounted on the substrate 1, two transformers 5, and a common mode filter module 7. The electrical connector 3 is used to mate with a cable assembly and so forms a Cable side. The transformer 5 further comprises a first wire 51 having two opposite ends electrically connected to the PHY side and a second wire 53 having two opposite ends. The common mode filter module 7 comprises two common mode filters. Each common mode filter has a third wire 73 and a fourth wire 75 that are physically separated from the second wire 53. The third wire 73 has an end electrically connected to one end of the second wire 53 and an opposite end electrically connected to the Cable side. The fourth wire 75 has an end electrically connected to the opposite end of the second wire 53 and an opposite end electrically connected to the Cable side.

The common mode filter 7 further comprises a plastic container 71, two magnetic cores received in the plastic container 71 and a plurality of conductive tails 77 molded together with the plastic container 71. The third wires 73 and the fourth wires 75 wind around the magnetic cores. The ends of the third and the fourth wires 73, 75 are respectively and electrically connected to said conductive tails 77. So, the container 71 makes the common mode filter 7 into an integrated common mode module that can be assembled conveniently.

The transformer 5 further comprises a ringy magnetic core and said first and said second wires 51, 53 are wound around the ringy magnetic core.

Figure 12A:
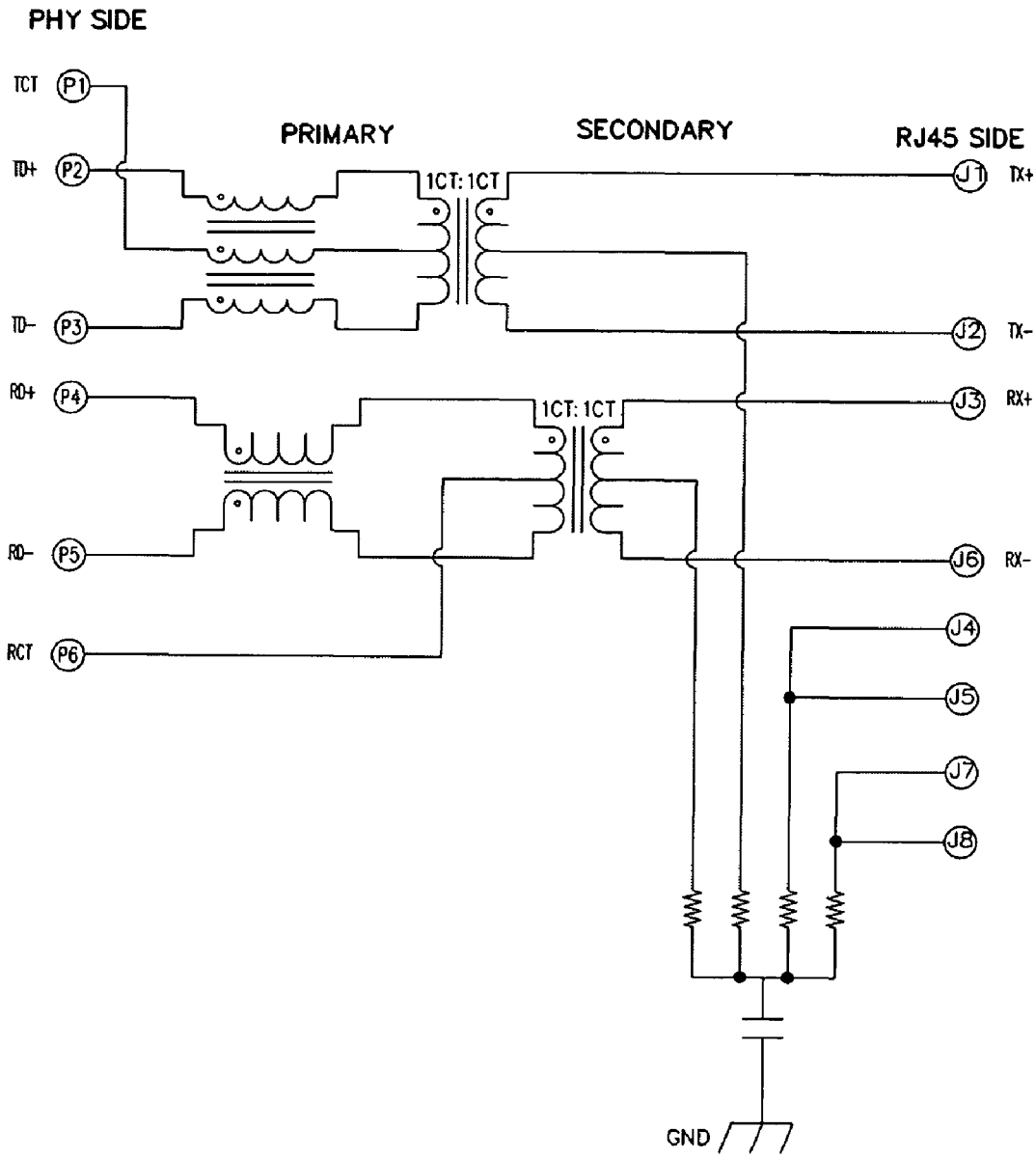
FIG. 12(*a*)-12(*d*) are circuit diagrams according to present invention.
Figure 12B:
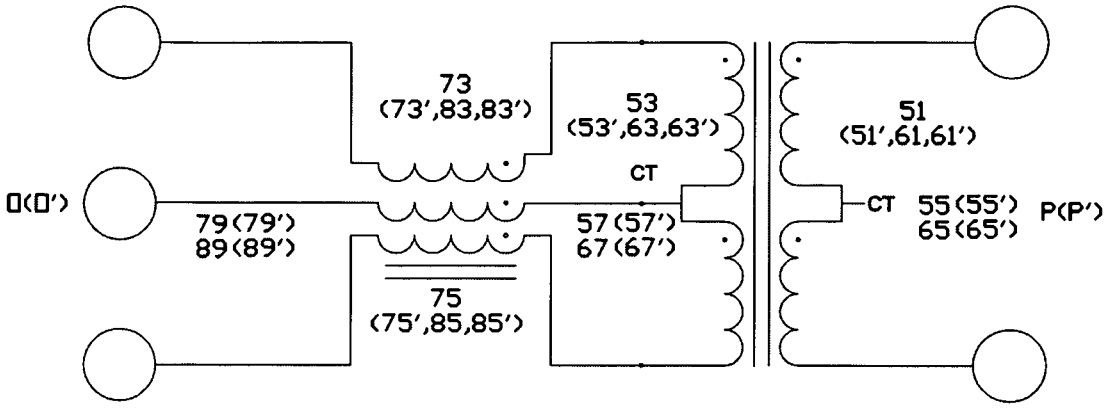
Figure 12C:
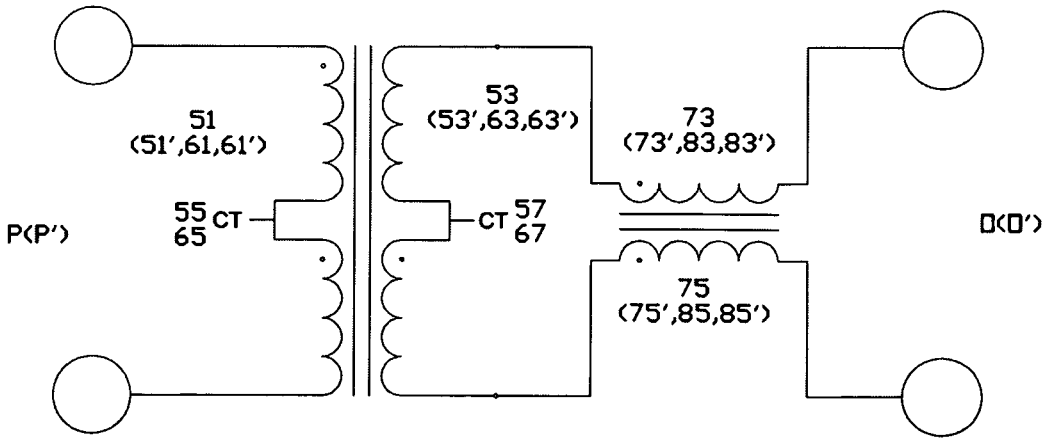

Referring to FIGS. 12A-12C, circuit diagrams of the network interface are provided. It is shown that each of said first and said second wires 51, 53 forms a center tap 55, 57. In one optional design, the center tap 55 of the first wire 51 is connected to ground, while the common mode module 7 further comprise a fifth wire 79 winding around the magnetic core, the center tap 57 of the second wire 53 is electrically connected to ground through the fifth wire 79, which is shown in FIG. 12B. In another optional design, the fifth wire 79 is not omitted and the center tap 57 of the second wire is electrically connected to ground directly, which is shown in FIG. 12C. It is similar to other designs of that center taps and a fifth wire may be optionally used to further improve noise filter.

Referring back to FIGS. 2 and 3, the electrical connector 3 further comprises an interior PCB 33, a plurality of mating contacts 35 and a plurality of transferring contacts 37 mounted on the interior PCB. The transformer 5 and the common mode module 7 are mounted on the interior PCB 33. The interior PCB 33 forms a plurality of conductive traces 331 and a plurality of conductive pads 333. The opposite ends of the first wire 51 are electrically connected to the PHY side through some of the conductive traces 331 of the interior PCB 33 and said transferring contacts 37. The opposite ends of the second wire 53 are respectively and electrically connected to ends of the third and the fourth wires 73, 75 sequentially through some of the conductive pads 333, some of the conductive trace 331 of the interior PCB 33, some other conductive pads 333, some of the conductive tails 77 and some other of the conductive pads 333. The opposite ends of the third and the fourth wires 73, 75 are electrically connected to the Cable side sequentially through some other of the conductive tails 77, some of the conductive traces 331 of the interior PCB 33 and the mating contacts 35.

Figure 12D:
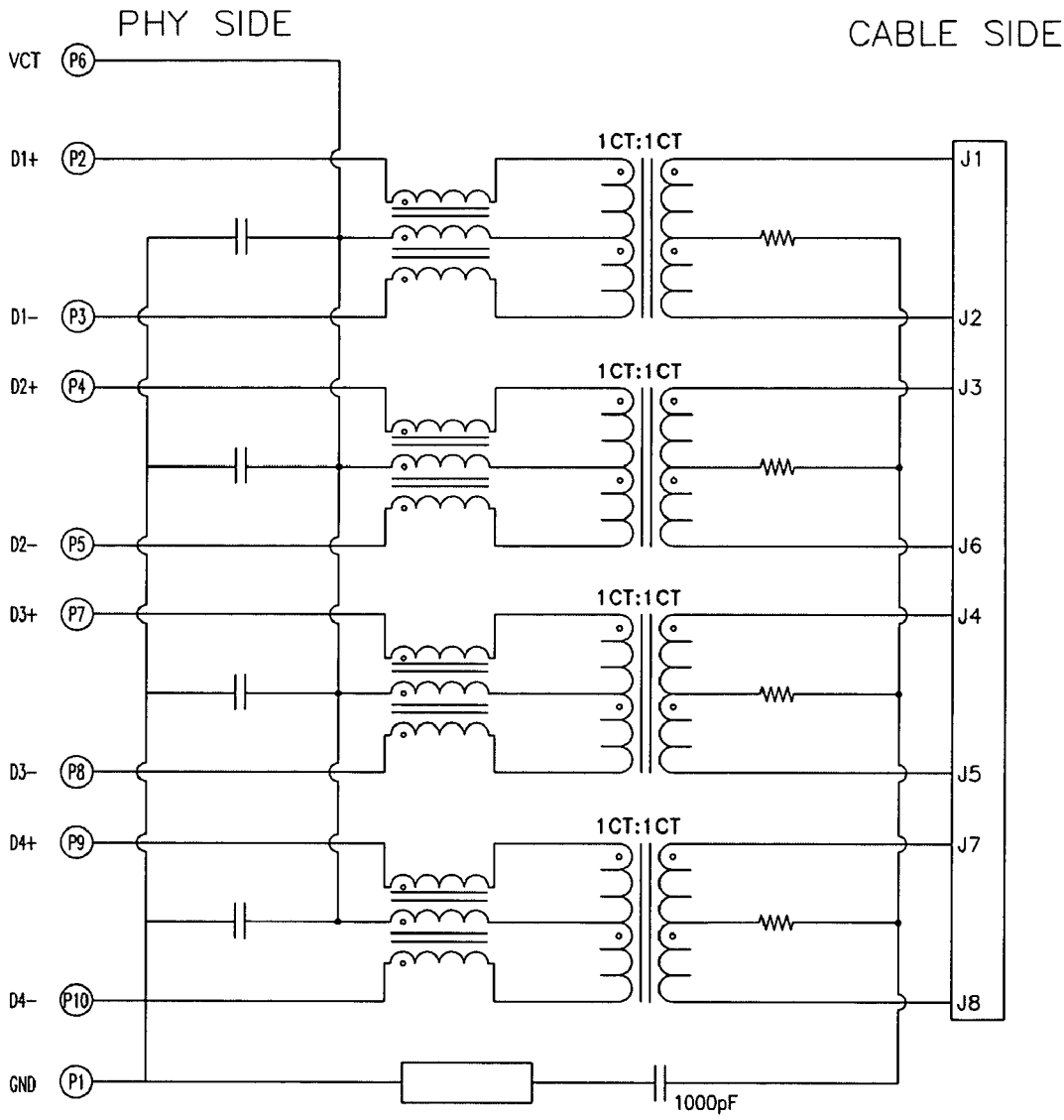
Figure 13:
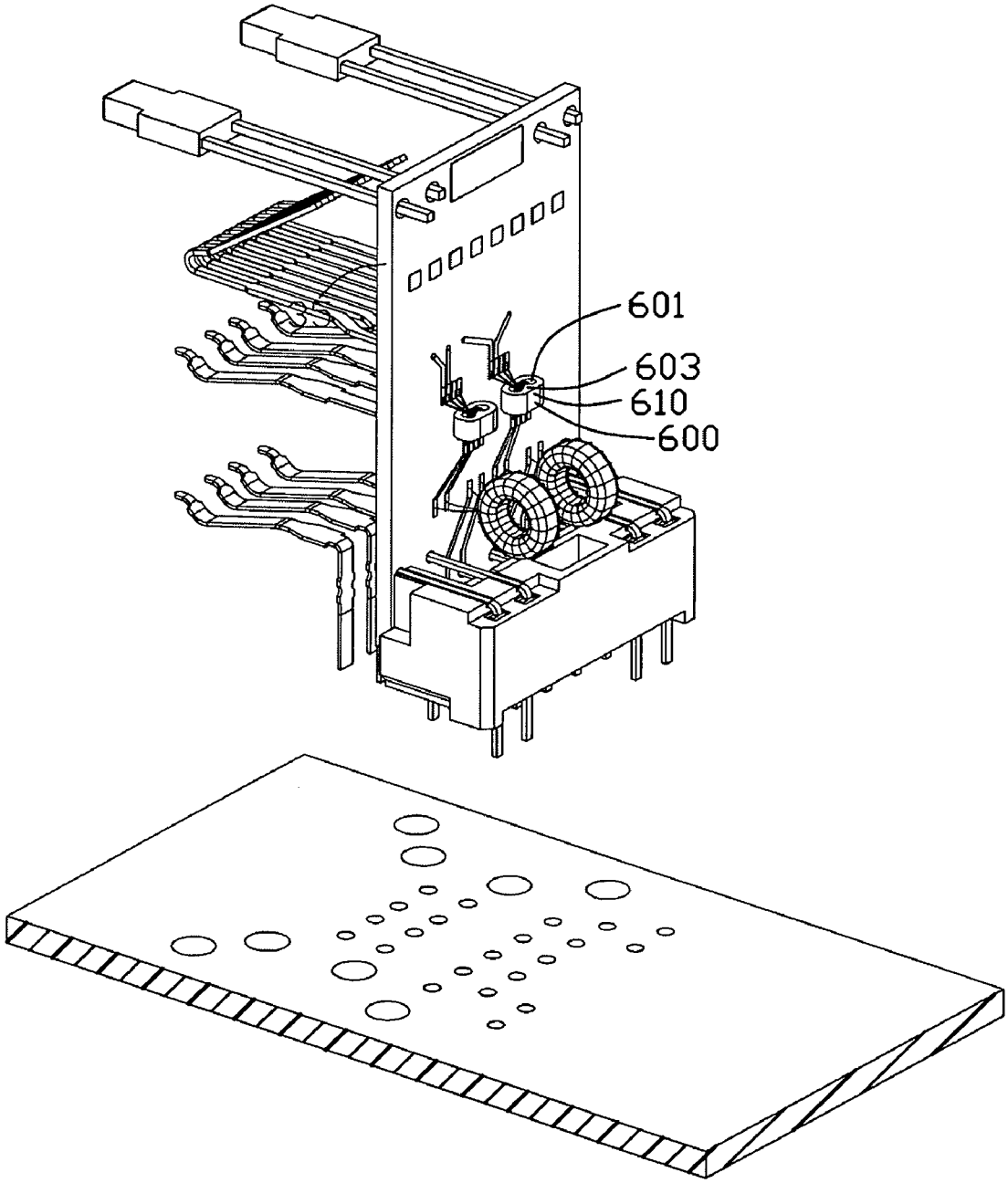
FIGS. 13-32 are perspective views of filter portions of electrical connector systems according to twenty embodiments of the present invention.
Figure 14:
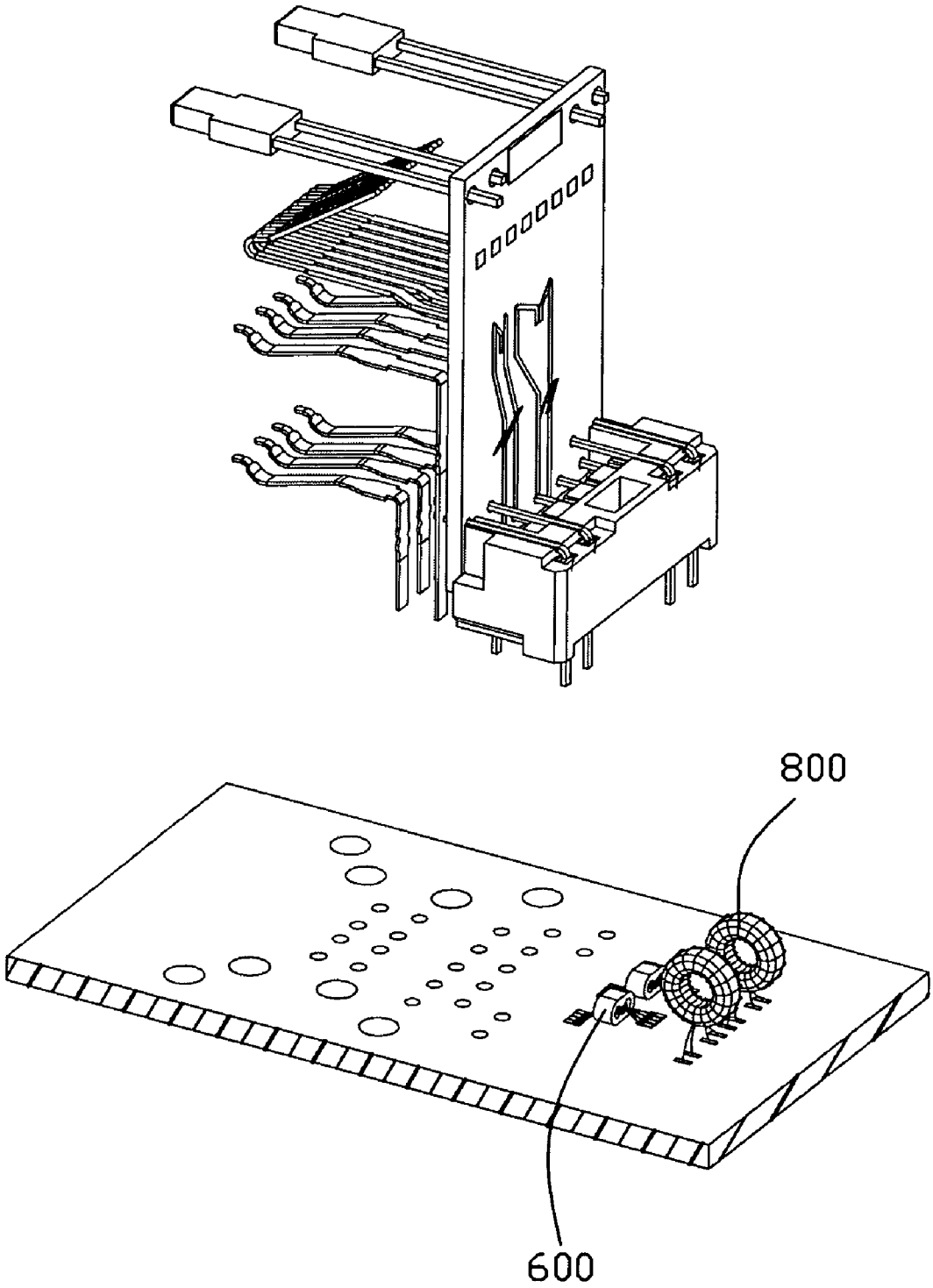
Figure 15:
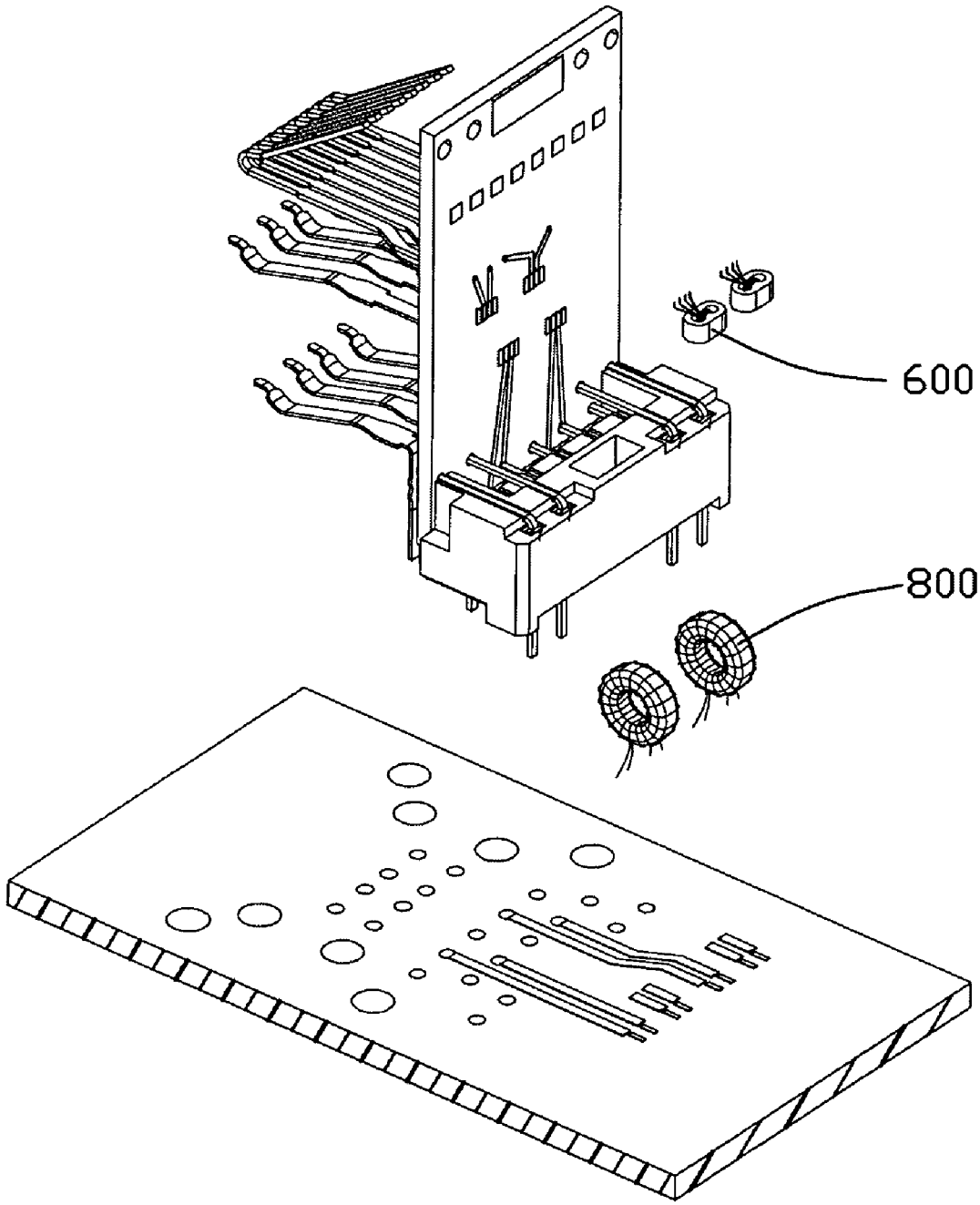
Figure 16:
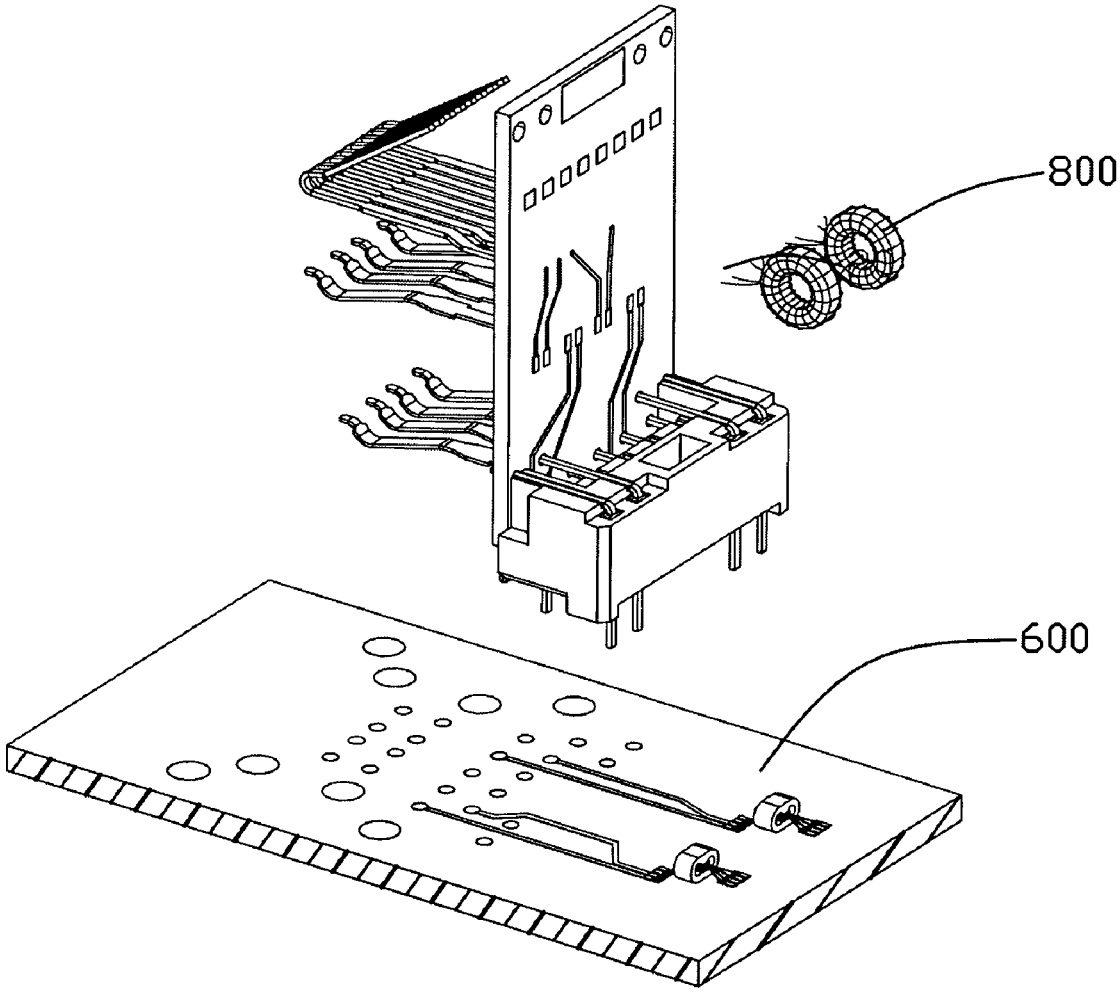
Figure 17:
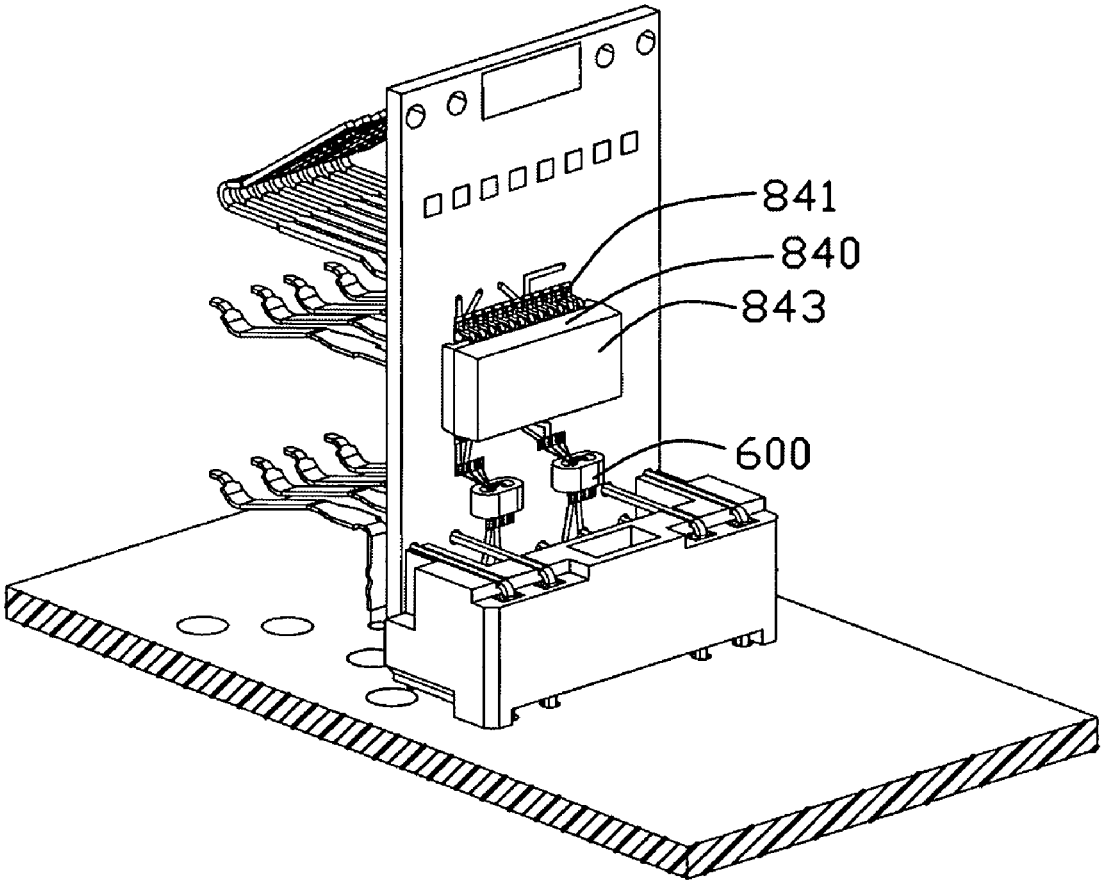
Figure 18:
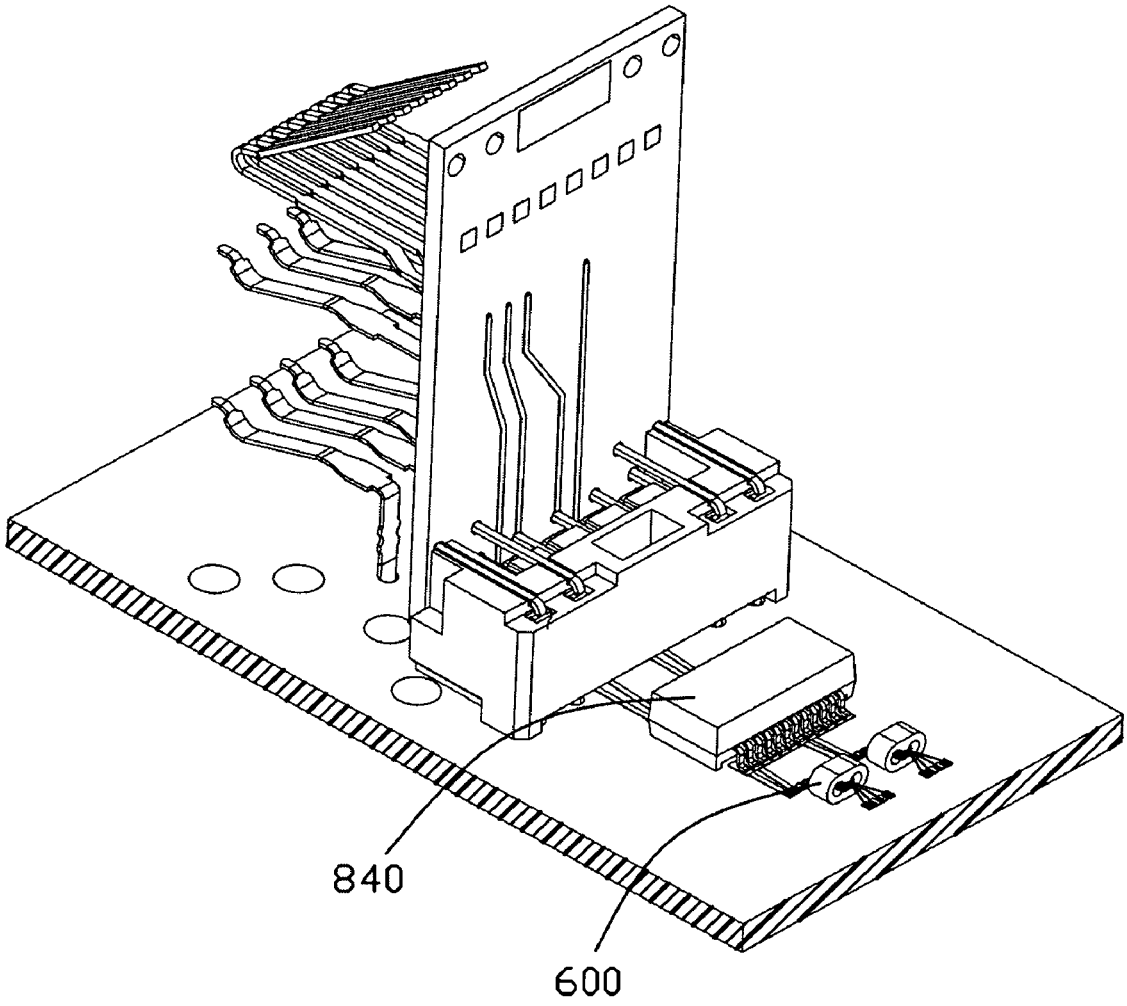
Figure 19:
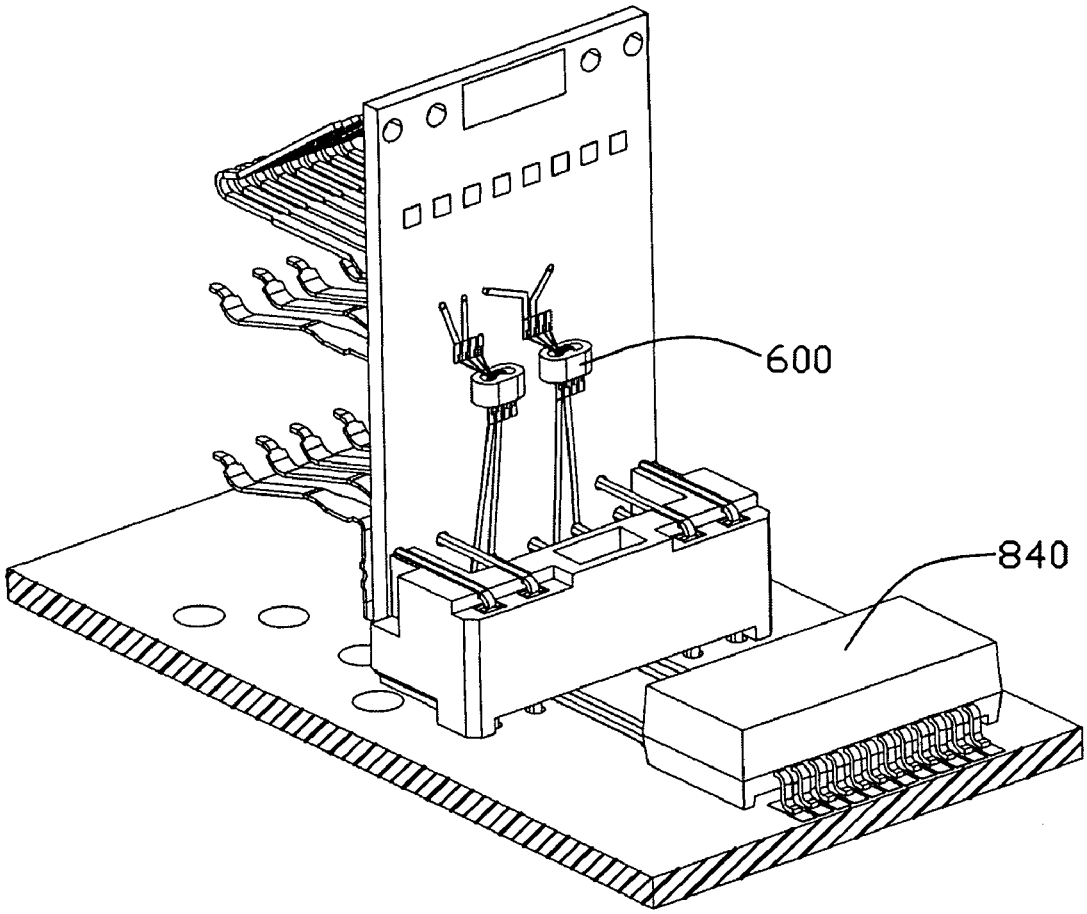
Figure 20:
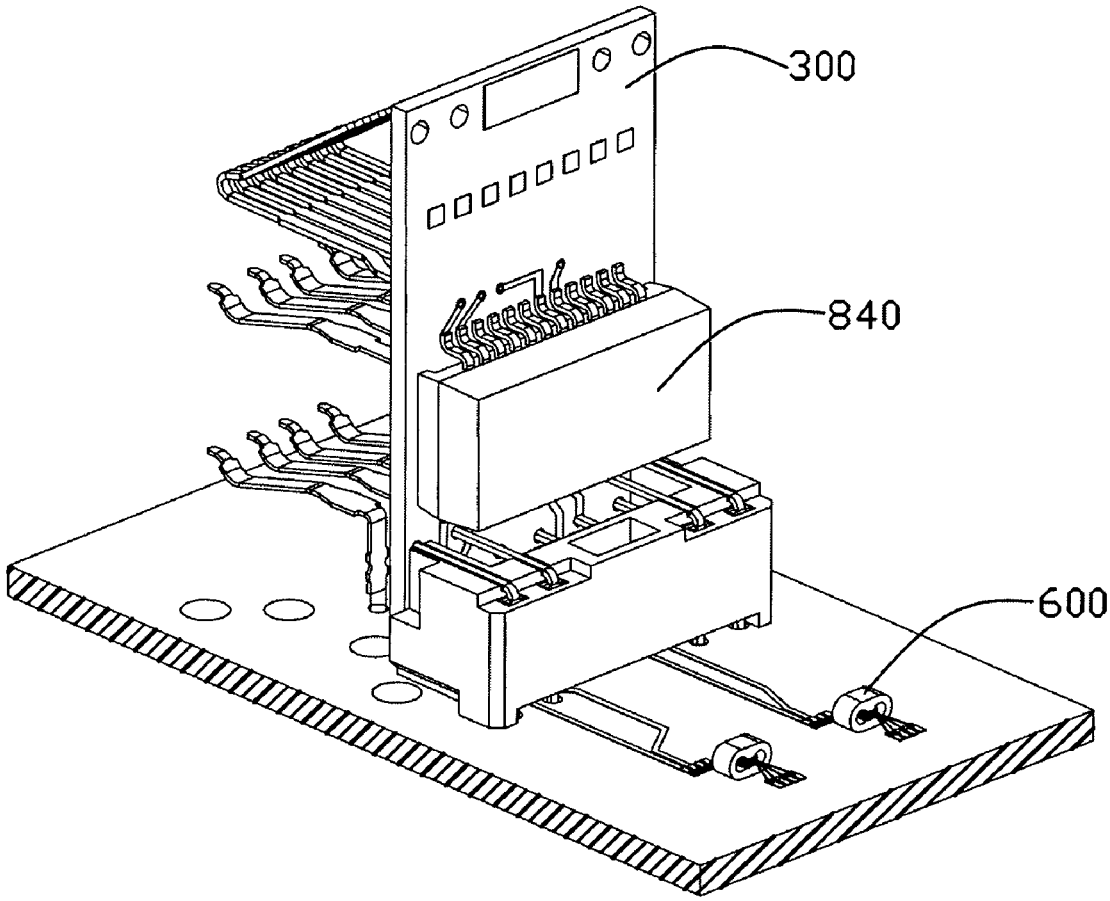
Figure 21:
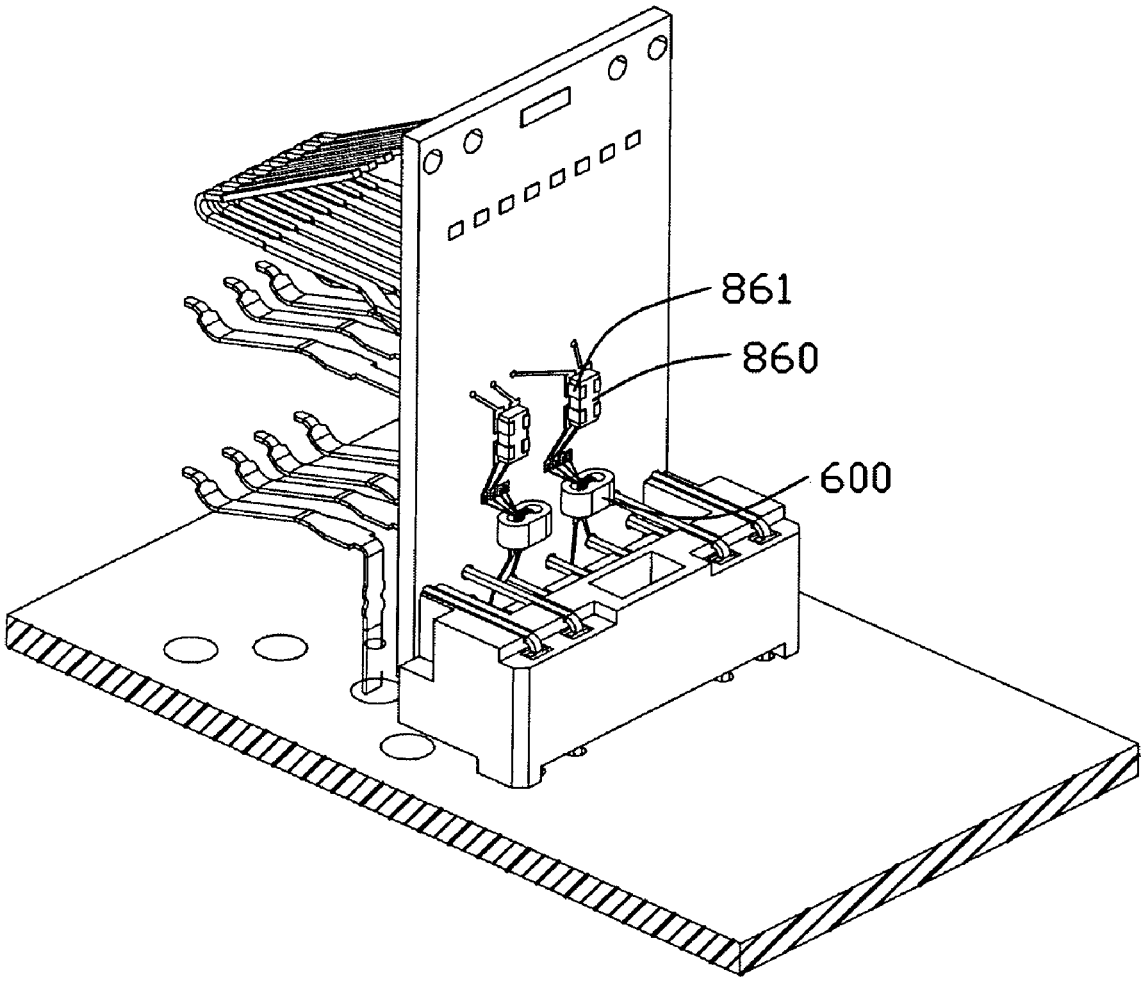
Figure 22:
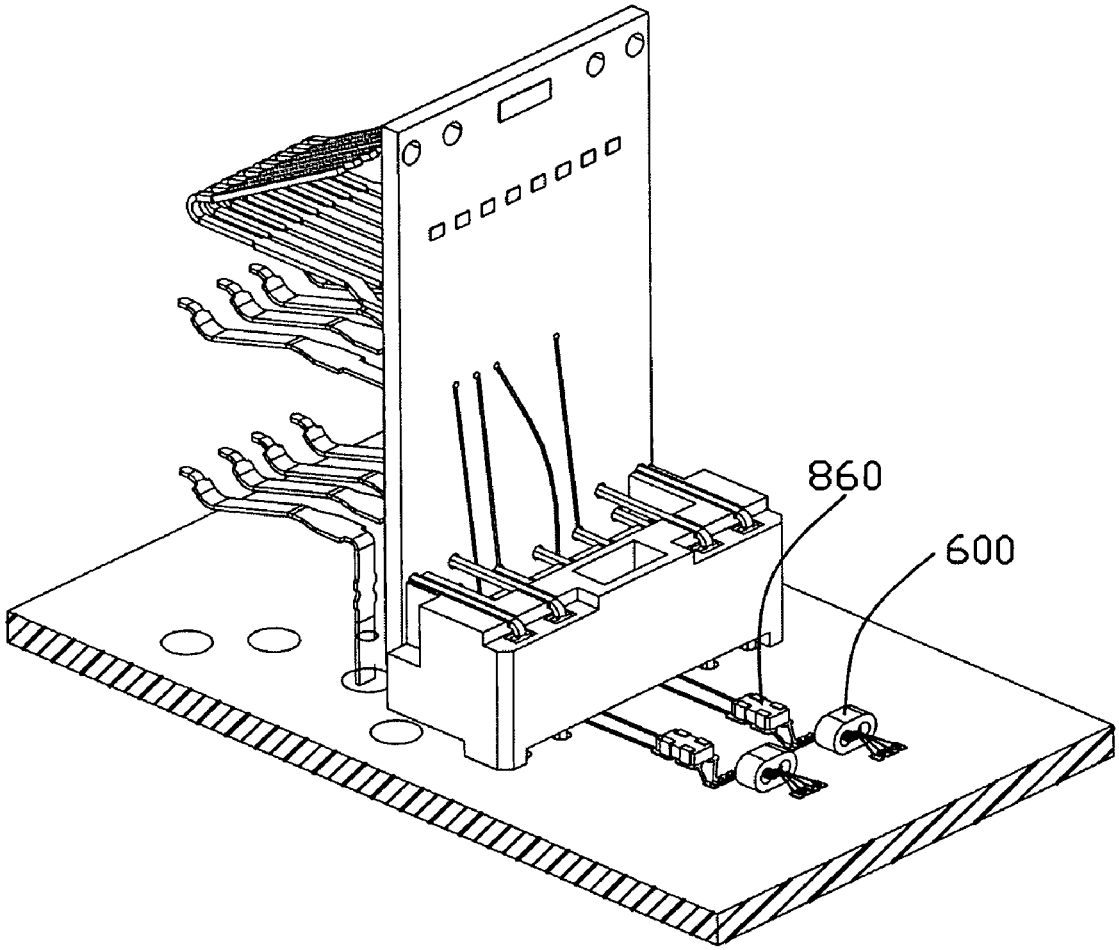
Figure 23:
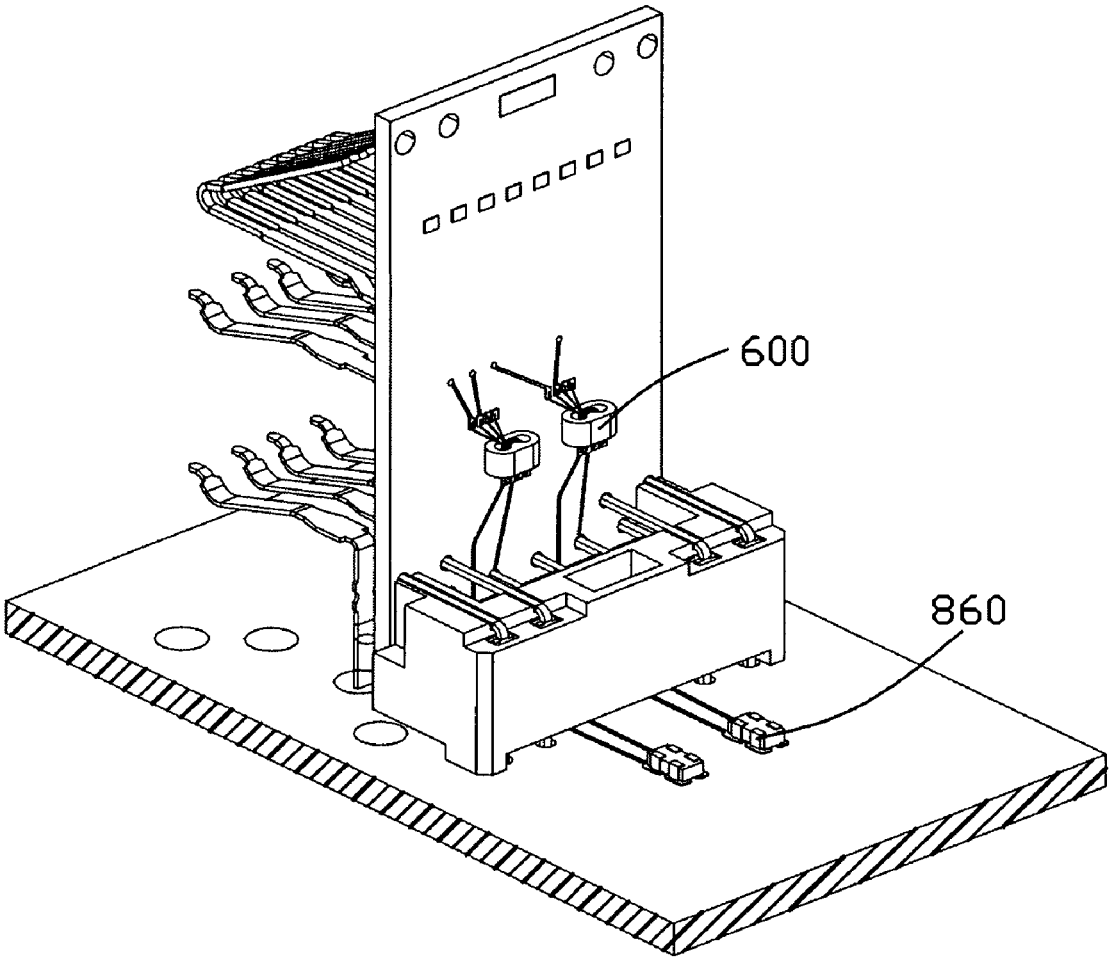
Figure 24:
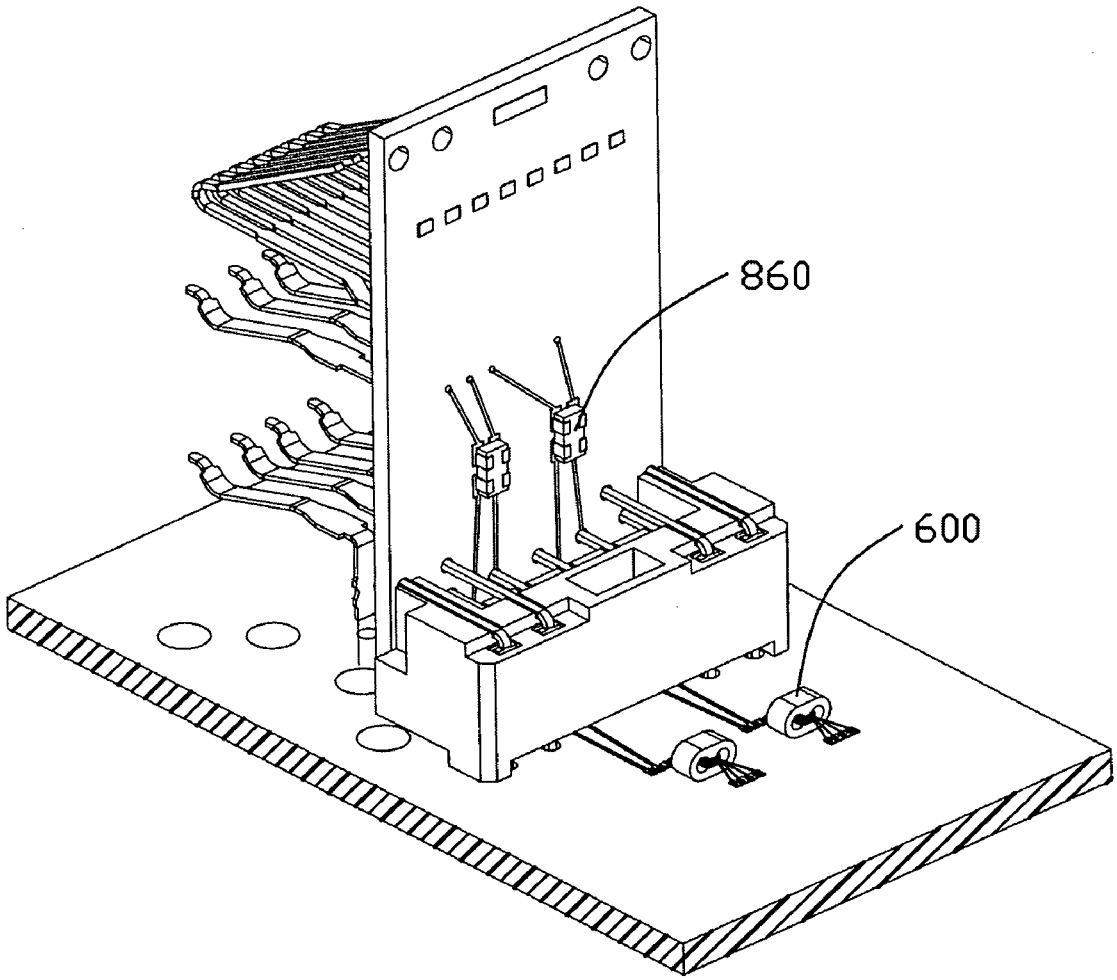
Figure 25:
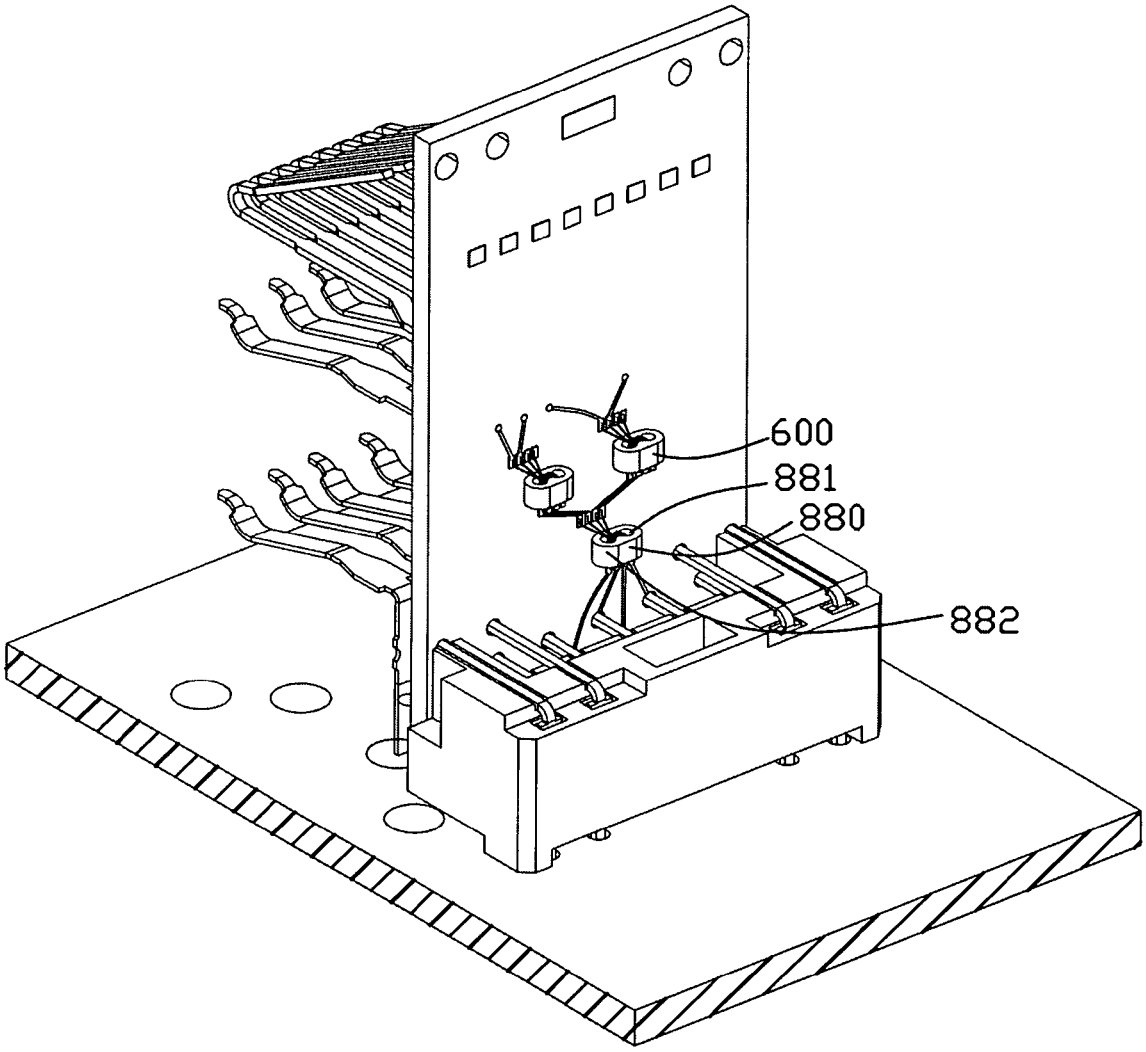
Figure 26:
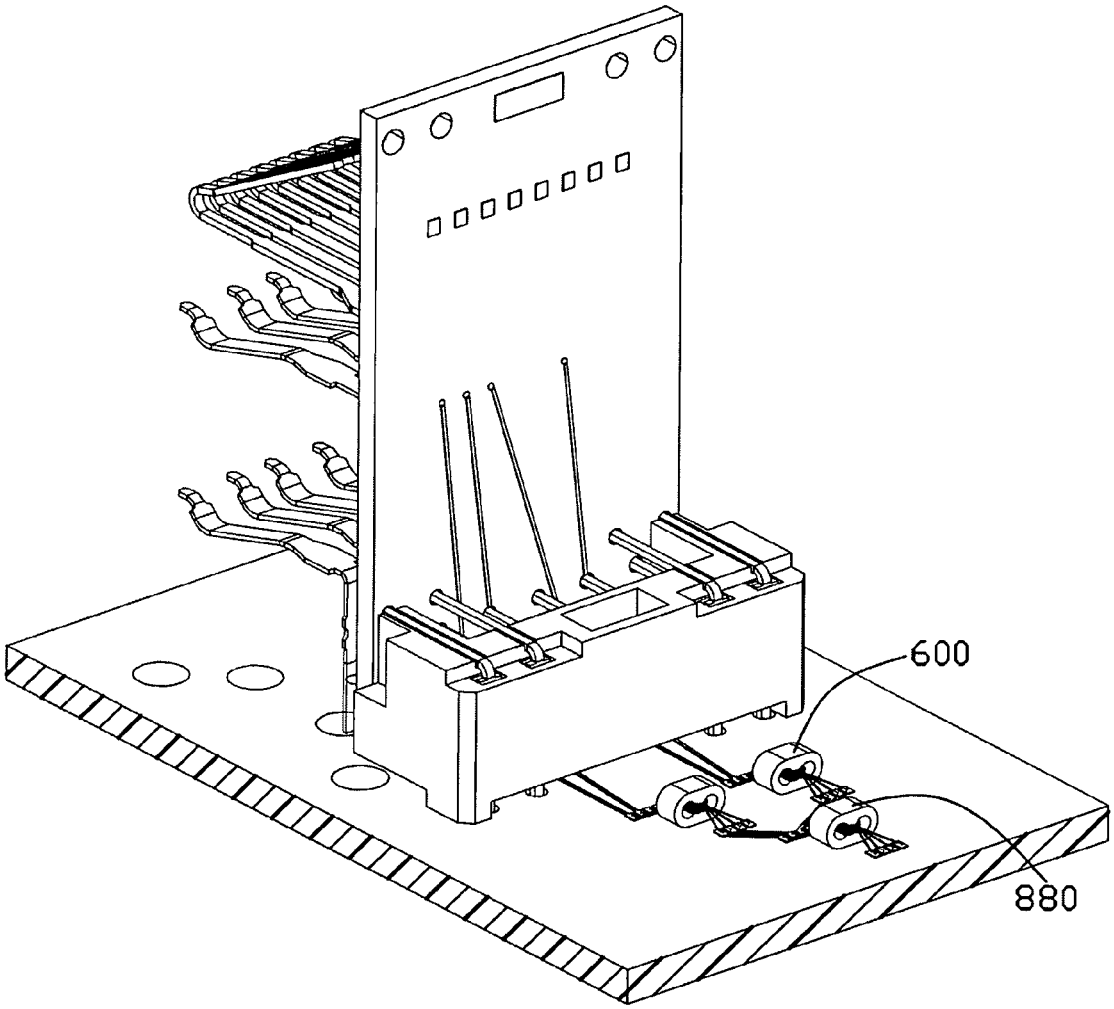
Figure 27:
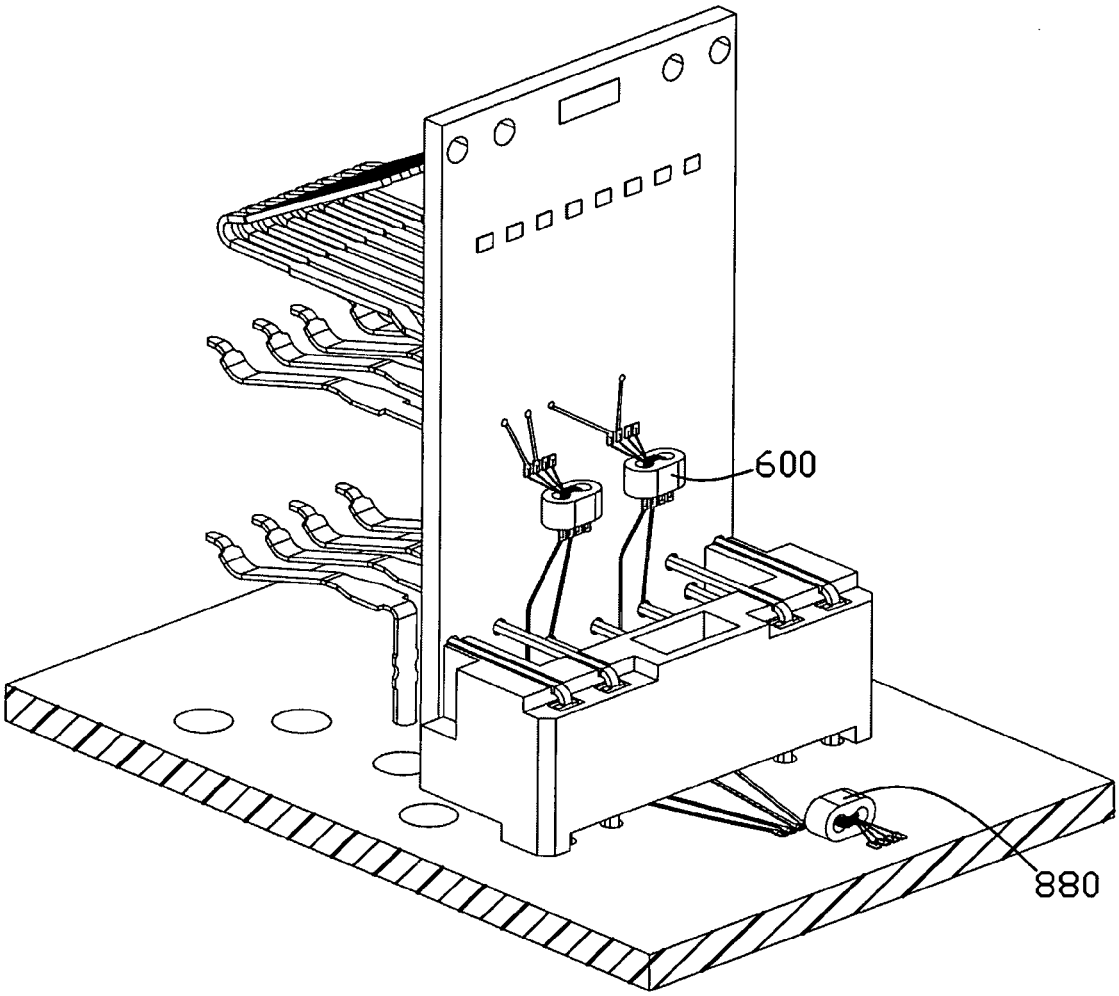
Figure 28:
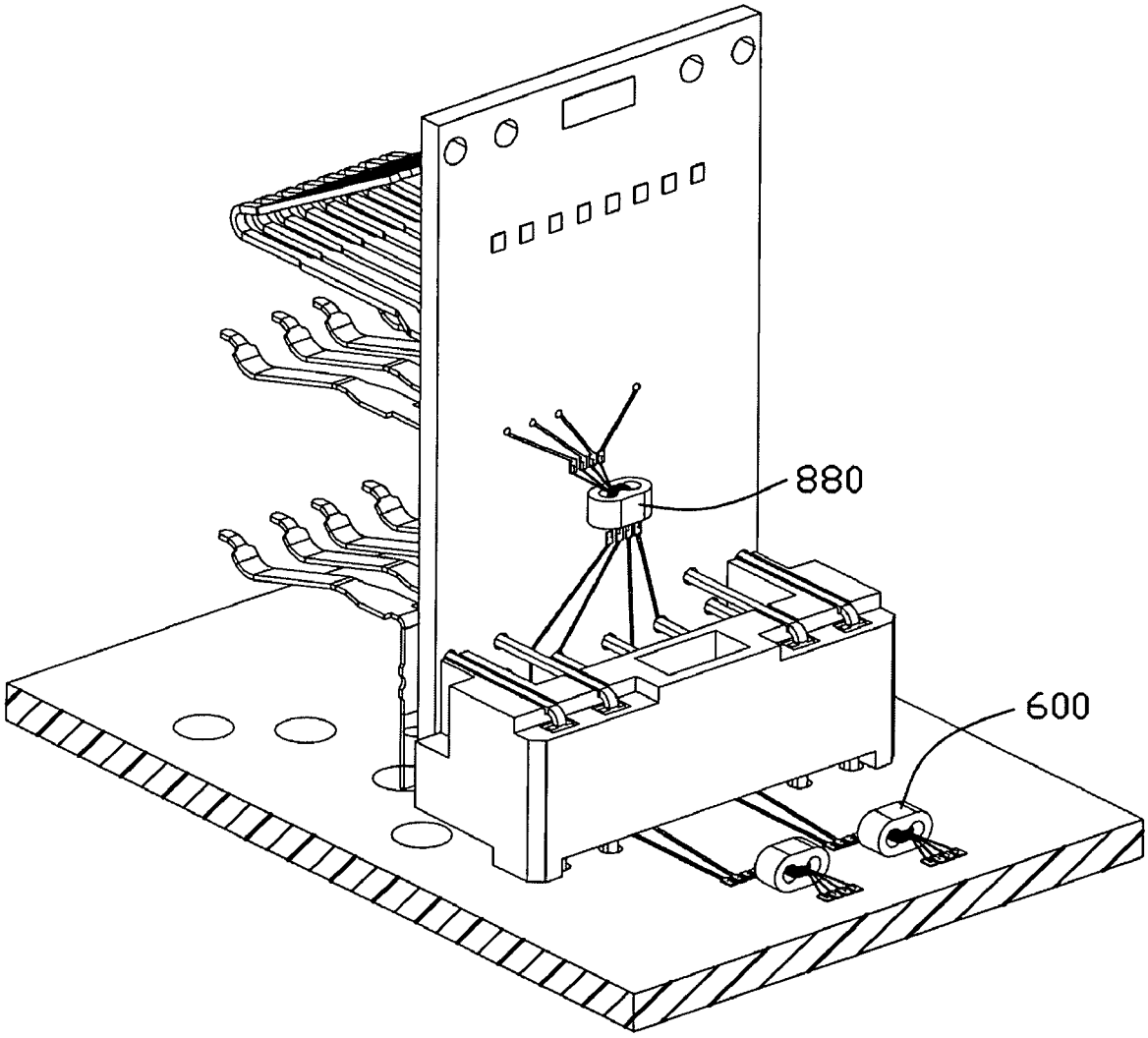
Figure 29:
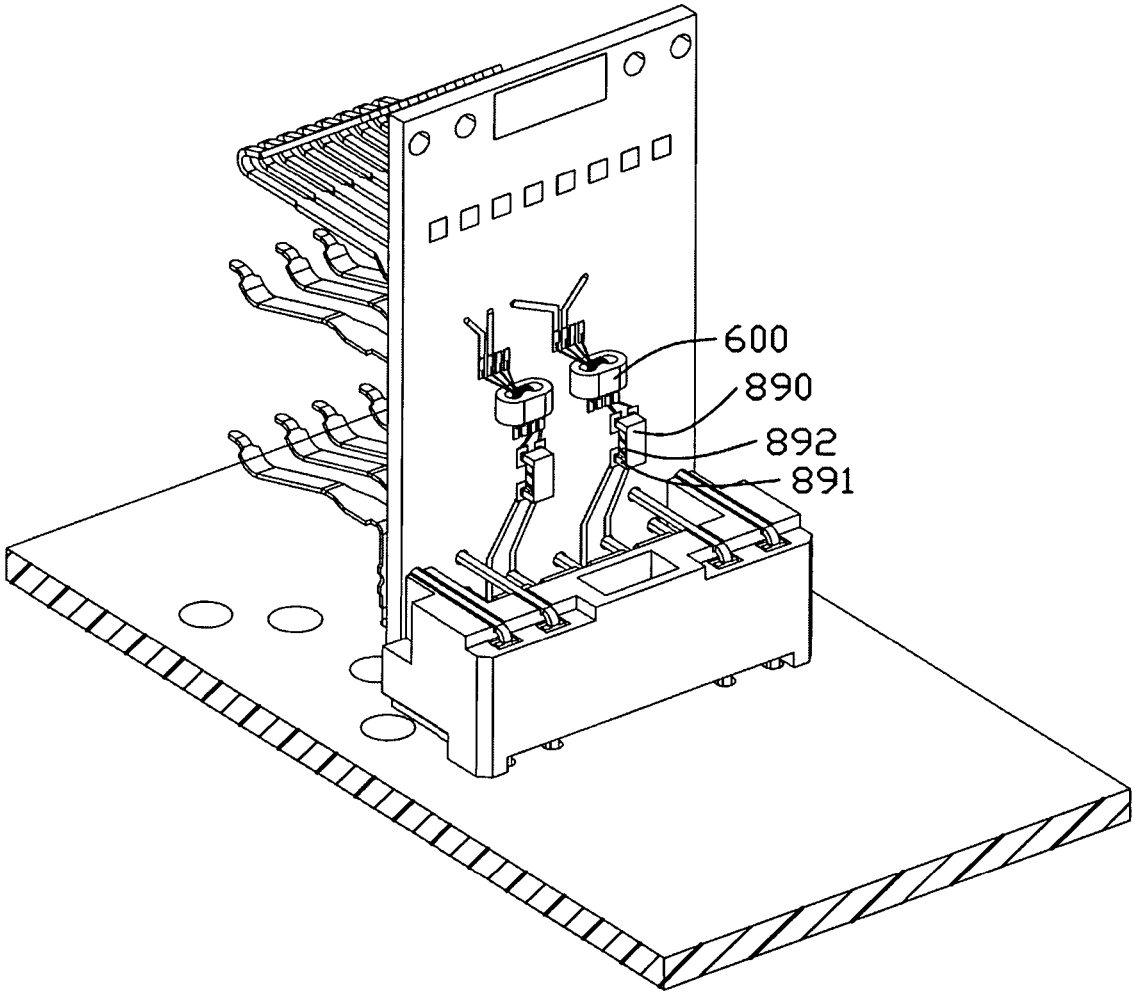
Figure 30:
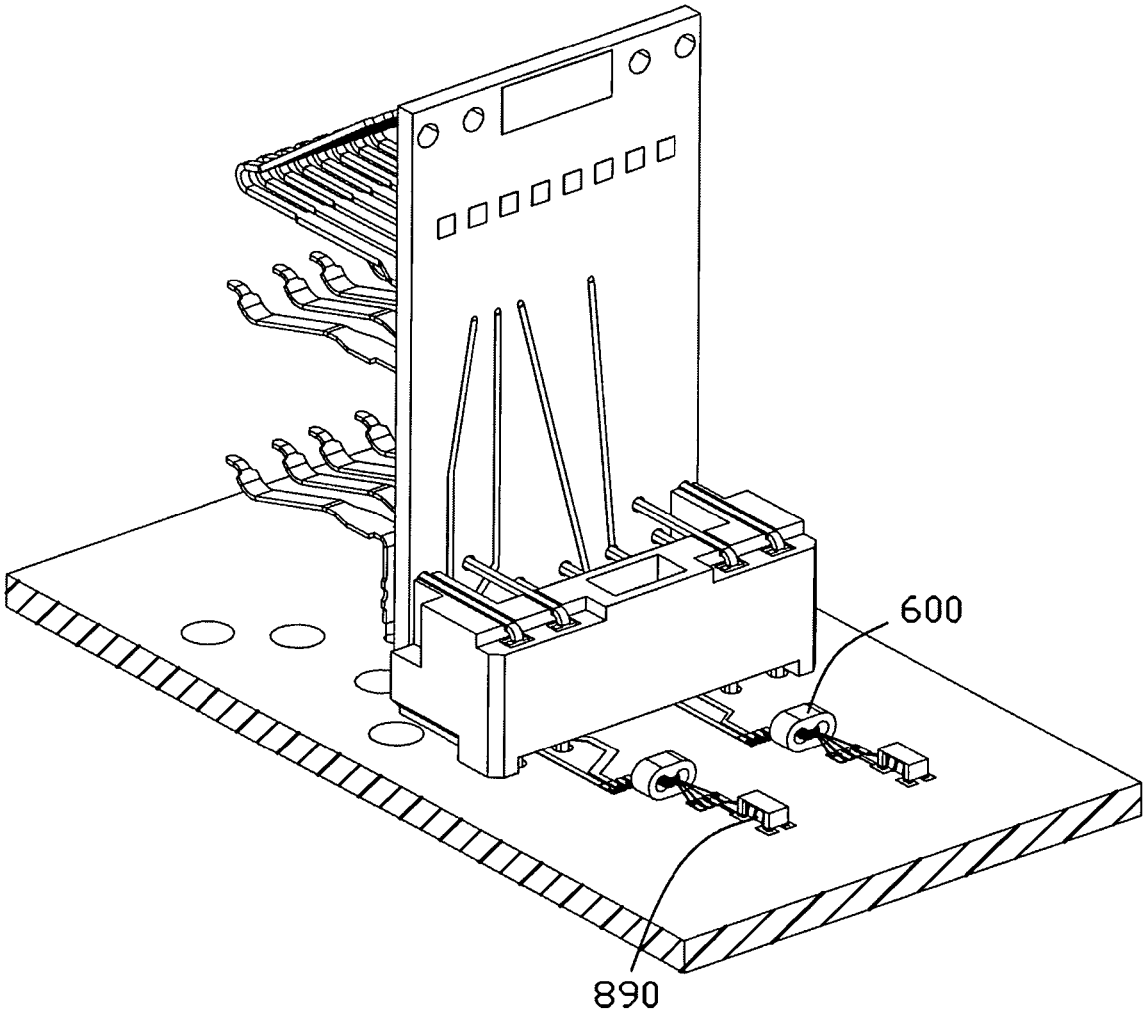
Figure 31:
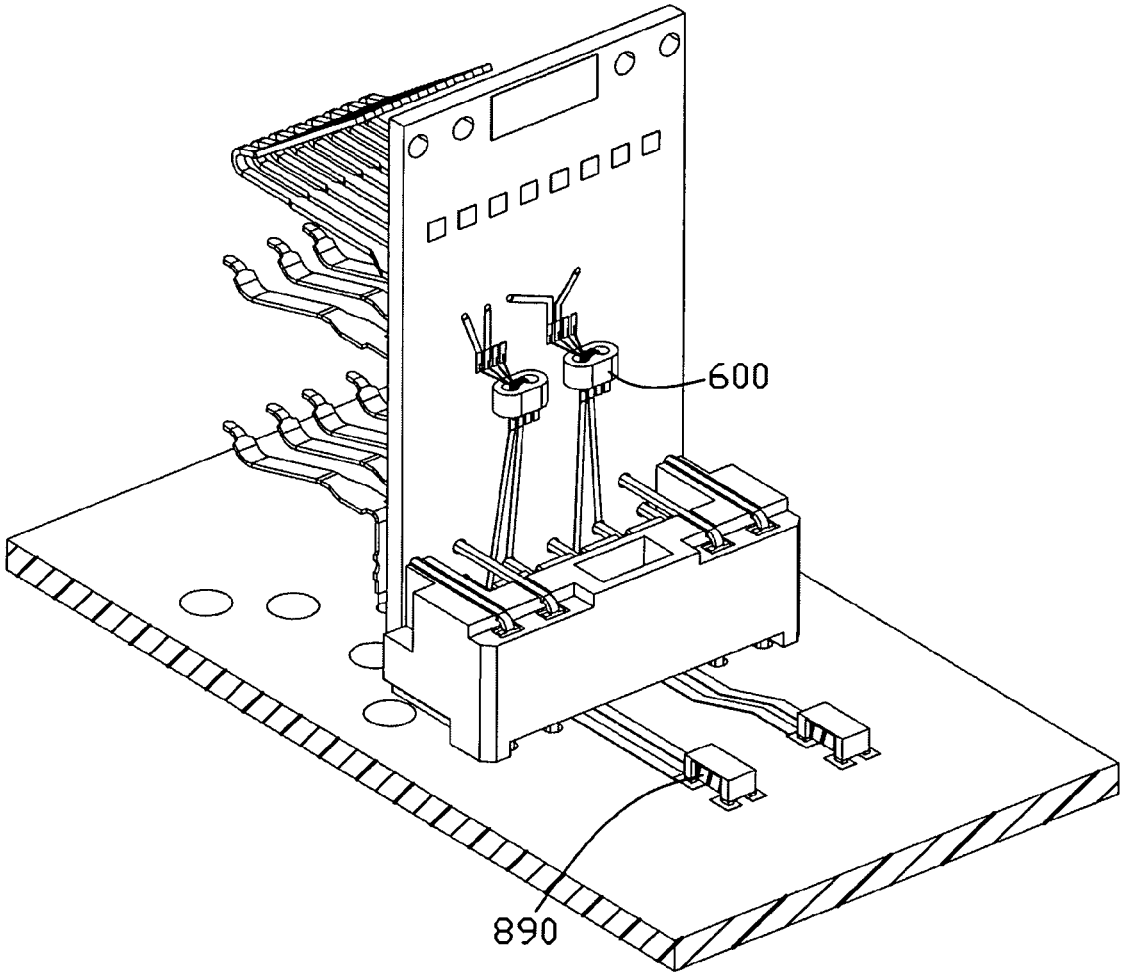
Figure 32:
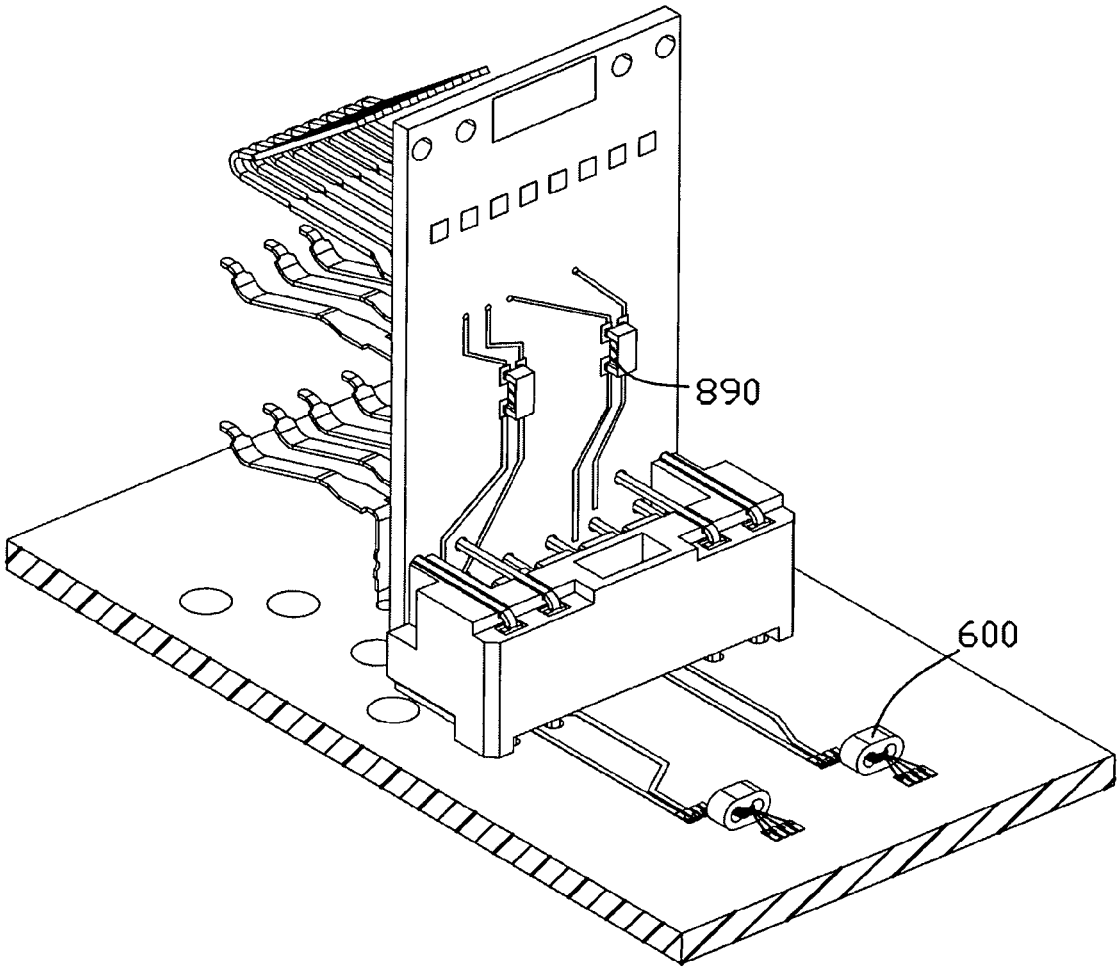

Referring to FIG. 12D, circuit diagram of an electrical connector system in 10-1000 based Ethernet application is shown, which is similar to the circuit diagram of 10/100 based Ethernet application except that there are four signal (or communication) channels.

Figure 4:
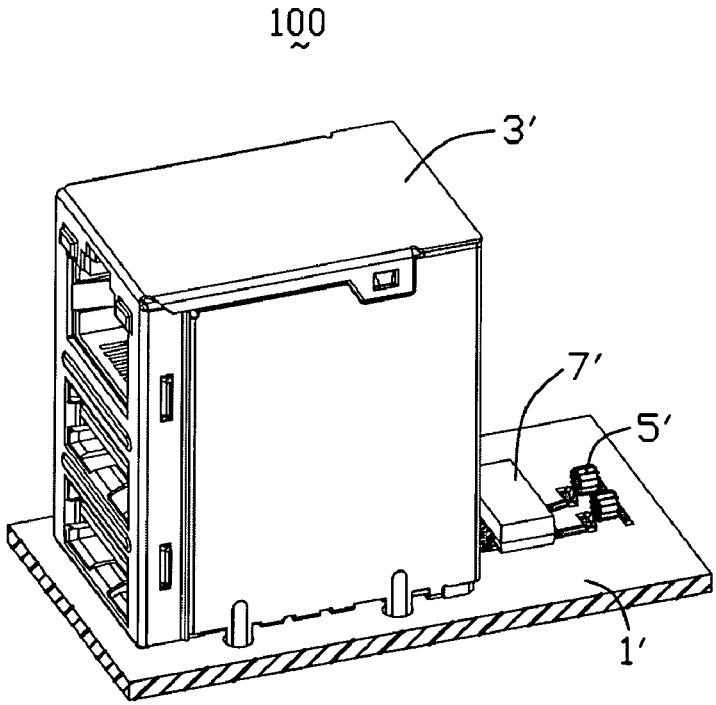
FIG. 4 is a perspective view of an electrical connector system according to a second design.
Figure 2:
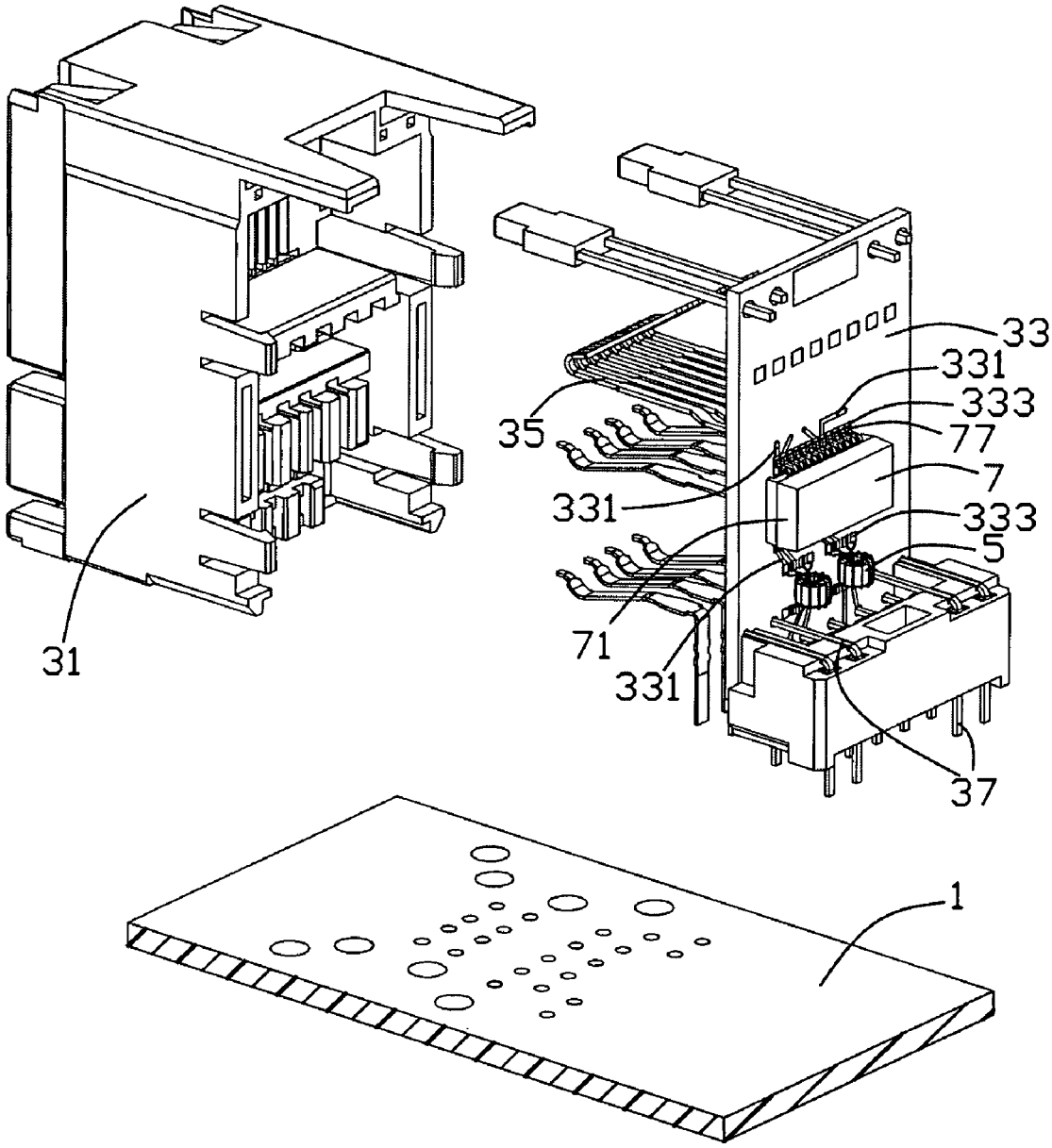
FIG. 2 is an exploded view of the electrical connector system shown in FIG. 1.
Figure 3:
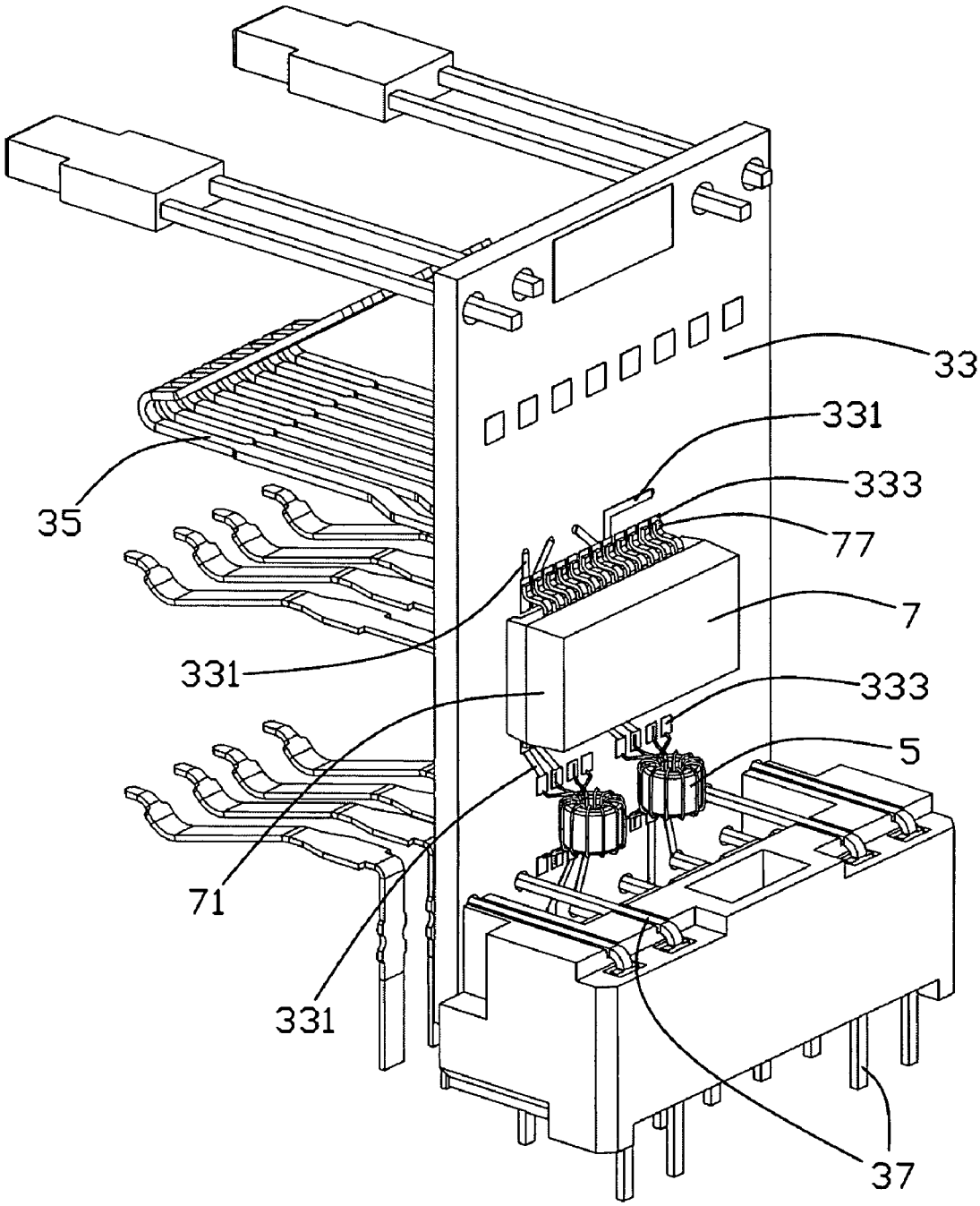
FIG. 3 is a perspective view of a filter portion shown in FIG. 2.
Figure 5:
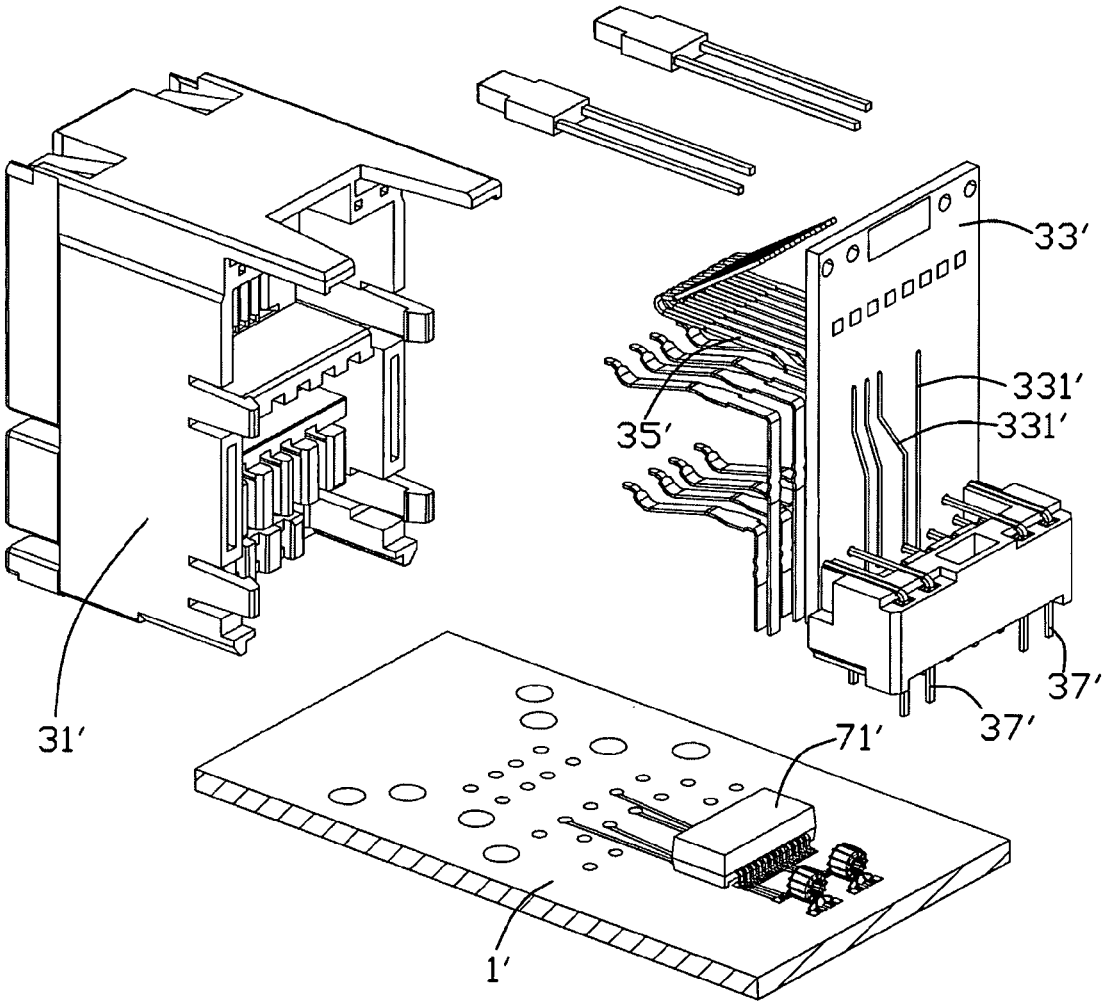
FIG. 5 is an exploded view of the electrical connector system shown in FIG. 4.
Figure 6:
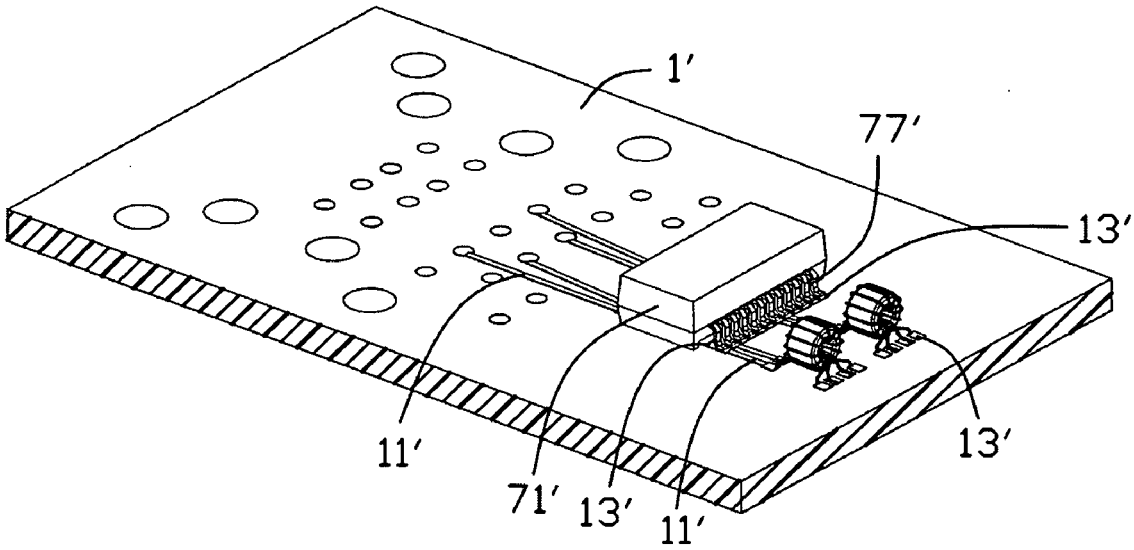
FIG. 6 is a perspective view of a filter portion shown in FIG. 2.

Referring to FIGS. 4-6, an electrical connector system according to a second design is shown. The electrical connector system comprises a substrate 1' forming a plurality of conductive traces 11' and an electrical connector 3' mounted on the substrate 1', a transformer 5' and a common mode filter 7'. The transformer 5' further comprises a first wire 51' having two opposite ends electrically connected to the PHY side and a second wire 53' having two opposite ends. The common mode filter 7 has a third wire 73' and a fourth wire 75' that are physically separated from the second wire 53'. The third wire 73' has an end electrically connected to one end of the second wire 53' and an opposite end electrically connected to the Cable side. The fourth wire 75' has an end electrically connected to the opposite end of the second wire 53' and an opposite end electrically connected to the Cable side.

The common mode filter 7' further comprises a plastic container 71', a magnetic core received in the plastic container 71' and a plurality of conductive tails 77' molded together with the plastic container 71'. The third wire 73' and the fourth wire 75' wind around the magnetic core. The ends of the third and the fourth wires 73', 75' are respectively and electrically connected to said conductive tails 77'. By this arrangement, the container 71' makes the common mode filter into an integrated common mode module to be assembled conveniently.

Referring to FIGS. 5 and 6, the transformer 5' and the common mode module 7' are mounted on the substrate 1'. The opposite ends of the first wire 51' are electrically connected to the PHY side by some said conductive traces 11' of the substrate 1'. The opposite ends of the second wire 53' are respectively and electrically connected to one ends of the third and the fourth wires 73', 75' through some of the conductive pads 13', some of the conductive trace 11' of the substrate 1', some other conductive pads 13', some of the conductive tails 77' and some other of the conductive pads 13'.

The electrical connector 3' further comprises an interior PCB 33'. The interior PCB 33' forms a plurality of conductive traces 331'. The electrical connector 3' further comprises a plurality of mating contacts 35' and a plurality of transferring contacts 37' mounted on the interior PCB. The third and the fourth wires 73', 75' are electrically connected to the Cable side through some conductive tails 77', some conductive traces 11' of the substrate 1', the transferring contacts 37', the conductive traces 331' and the mating contacts 35'.

Figure 7:
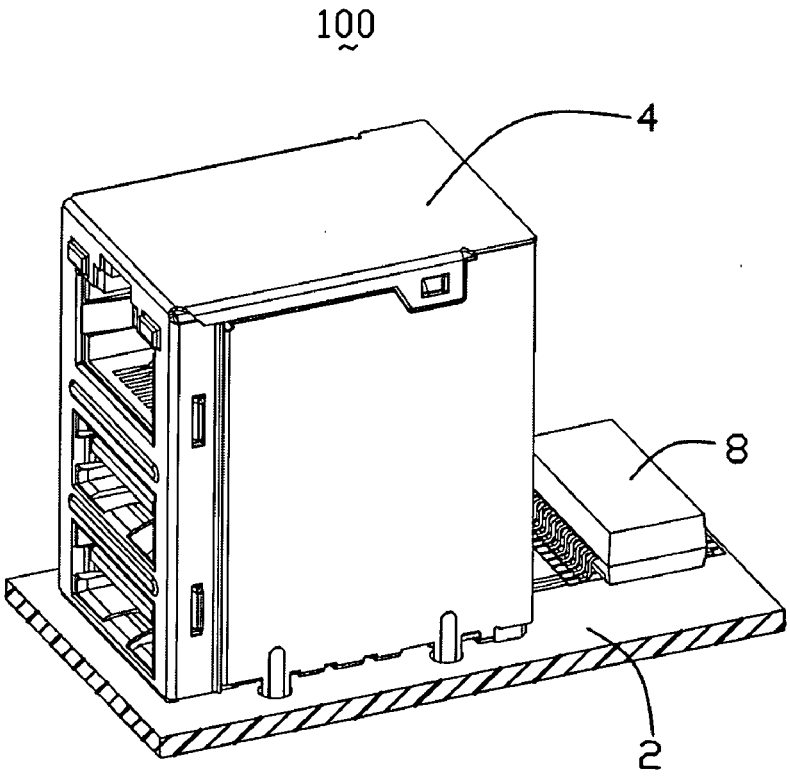
FIG. 7 is a perspective view of an electrical connector system according to a third design.
Figure 8:
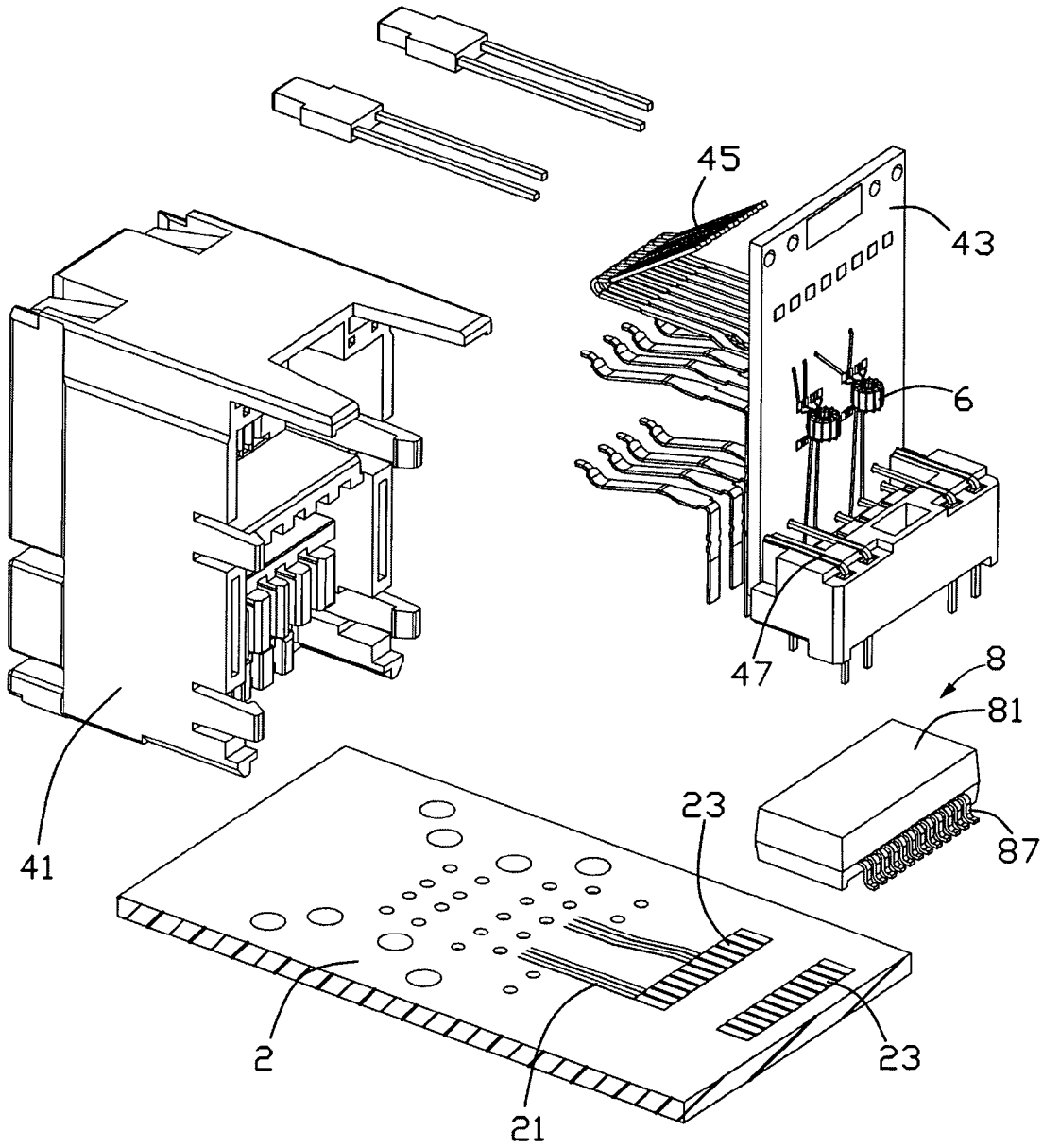
FIG. 8 is an exploded view of the electrical connector system shown in FIG. 7.
Figure 9:
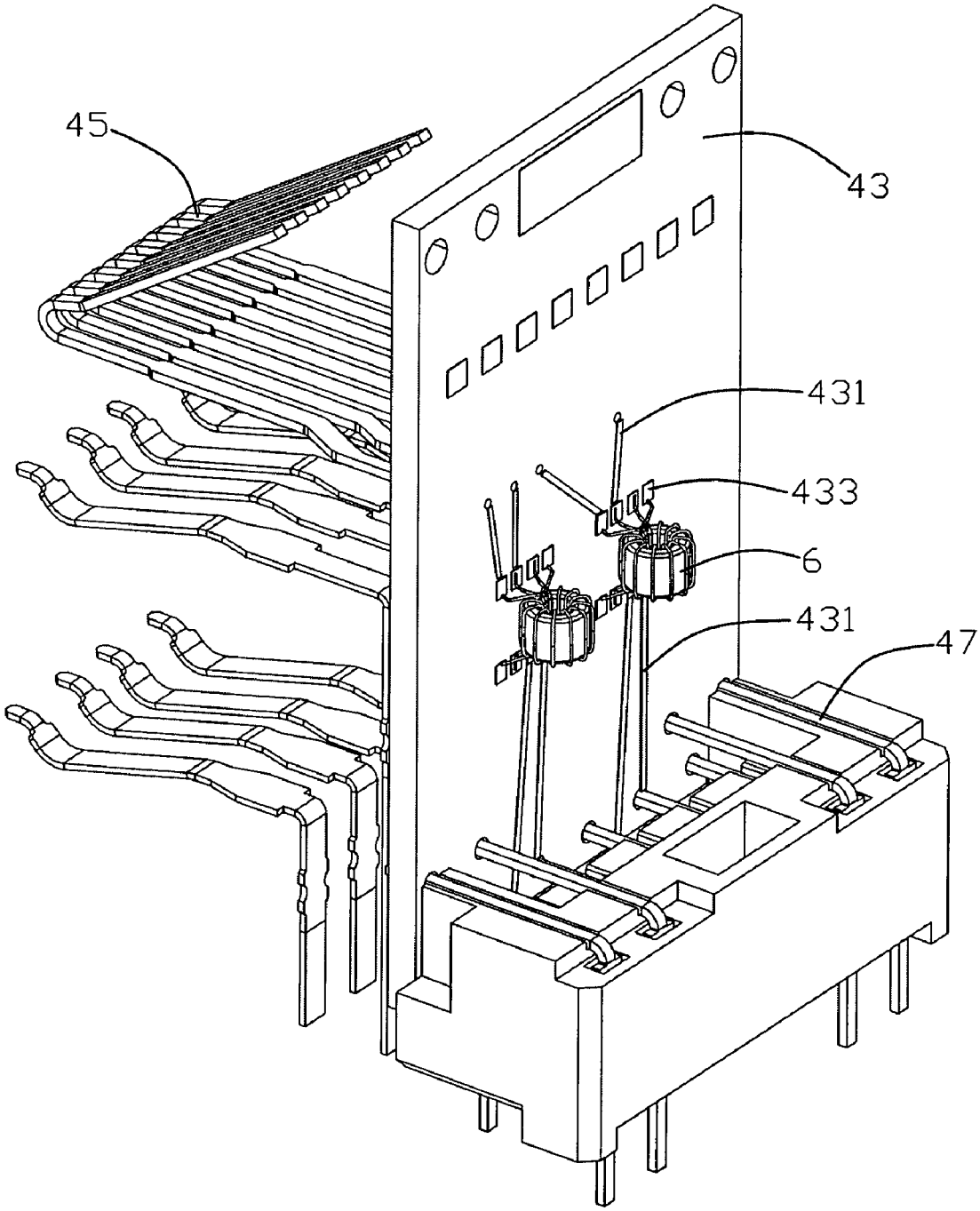
FIG. 9 is a perspective view of a filter portion shown in FIG. 8.

Referring to FIGS. 7-9, an electrical connector system according to a third design is shown. The electrical connector system comprises a substrate 2 forming a plurality of conductive traces 21 and an electrical connector 4 mounted on the substrate 2, a transformer 6 and a common mode filter 8. The transformer 6 further comprises a first wire 61 having two opposite ends electrically connected to the Cable side and a second wire 63 having two opposite ends. The common mode filter 8 has a third wire 83 and a fourth wire 85 that are physically separated from the second wire 63. The third wire 83 has an end electrically connected to one end of the second wire 63 and an opposite end electrically connected to the PHY side. The fourth wire 85 has an end electrically connected to the opposite end of the second wire 63 and an opposite end electrically connected to the PHY side. As a result, the PHY side and the Cable side are completely opposite to circuit diagram shown in FIG. 12A.

The common mode filter 8 further comprises a plastic container 81, a magnetic core received in the plastic container 81 and a plurality of conductive tails 87 molded together with the plastic container 81. The third wire 83 and the fourth wire 85 wind around the magnetic core. The ends of the third and the fourth wires 83,85 are respectively and electrically connected to said conductive tails 87. By this arrangement, the container 81 makes the common mode filter into an integrated common mode module to be assembled conveniently.

Referring to FIGS. 8 and 9, the substrate 2 comprises a plurality of conductive traces 21 and a plurality of conductive pads 23. The common mode module 8 is mounted on the substrate 2. The electrical connector 4 further comprises an interior PCB 43. The interior PCB 43 forms a plurality of conductive traces 431 and a plurality of conductive pads 433. The transformer 6 is mounted on the interior PCB 43. The electrical connector 4 further comprises a plurality of mating contacts 45 and a plurality of transferring contacts 47 mounted on the interior PCB.

Figure 10:
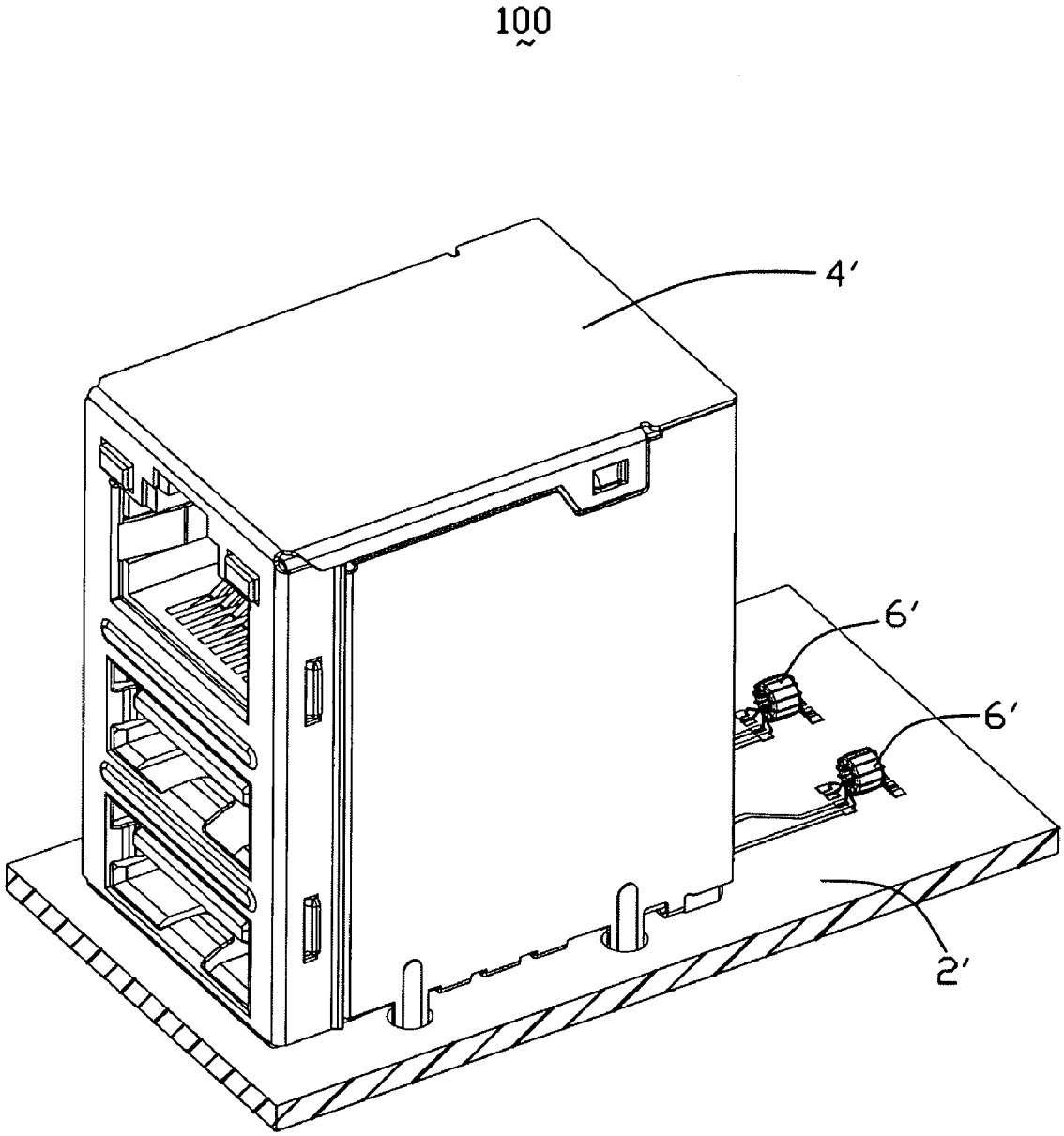
FIG. 10 is a perspective view of an electrical connector system according to a fourth design.
Figure 11:
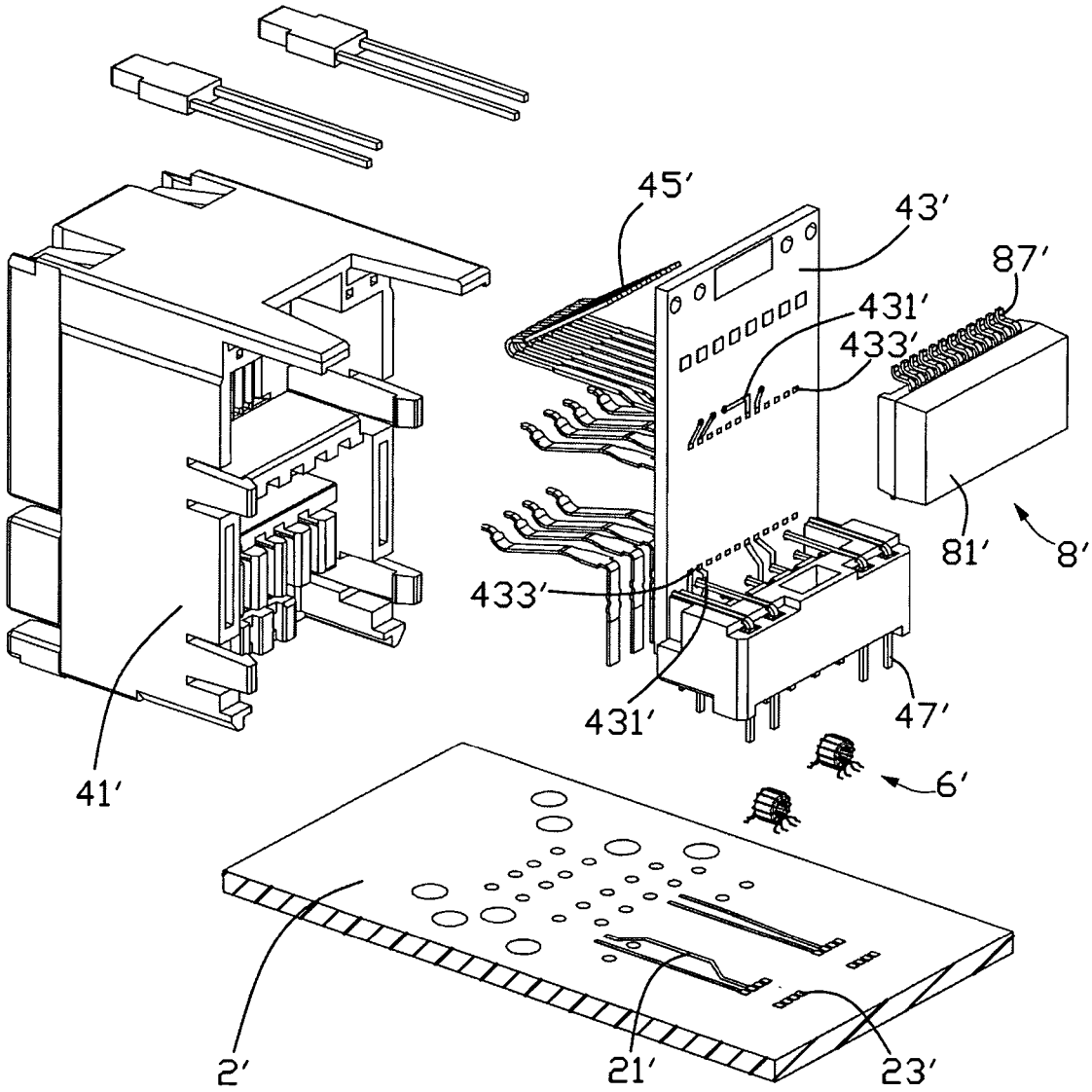
FIG. 11 is an exploded view of the electrical connector system shown in FIG. 10.

Referring to FIGS. 10-11, an electrical connector system according to a fourth design is shown. The electrical connector system comprises a substrate 2' forming a plurality of conductive traces 21' and an electrical connector 4' mounted on the substrate 2', a transformer 6' and a common mode filter 8'. The transformer 6' further comprises a first wire 61' having two opposite ends electrically connected to the PHY side and a second wire 63' having two opposite ends. The common mode filter 8' has a third wire 83' and a fourth wire 85' that are physically separated from the second wire 63'. The third wire 83' has an end electrically connected to one end of the second wire 63' and an opposite end electrically connected to the Cable side. The fourth wire 85' has an end electrically connected to the opposite end of the second wire 63' and an opposite end electrically connected to the Cable side. The circuit diagram of the fourth design is shown in FIG. 12B.

The common mode filter 8' further comprises a plastic container 81', a magnetic core received in the plastic container 81' and a plurality of conductive tails 87' molded together with the plastic container 81'. The third wire 83' and the fourth wire 85' wind around the magnetic core. The ends of the third and the fourth wires 83', 85' are respectively and electrically connected to said conductive tails 87'. By this arrangement, the container 81' makes the common mode filter into an integrated common mode module to be assembled conveniently.

Referring to FIG. 11, the transformer 6' is mounted on the substrate 2'. The electrical connector 4' further comprises an interior PCB 43'. The interior PCB 43' forms a plurality of conductive traces 431' and a plurality of conductive pads 433'. The common mode filter 8' is mounted on the interior PCB 43'. The electrical connector 4' further comprises a plurality of mating contacts 45' and a plurality of transferring contacts 47' mounted on the interior PCB.

Referring back to the third and fourth designs, the opposite ends of the second wire 63, 63' and the one ends of the third and the fourth wires are respectively and electrically connected through some of the conductive pads 433, 433' and conductive traces 431, 431' of the interior PCB 43, 43', the transferring contacts 47, 47', some of the conductive traces 21, 21' and conductive pads 23, 23' of the substrate 2, 2'. According to the first to the fourth designs, the second wire 53, 53', 63, 63' of the transformer 5, 5', 6, 6' is physically separated from the wires of the common mode filter 7, 7', 8, 8', so that the transformer 5, 5', 6, 6' and the common mode filter 7, 7', 8, 8' could be separately manufactured conveniently. Furthermore, the common mode filter 7, 7', 8, 8' and the trans-former 5, 5', 6, 6' could be optionally mounted onto the substrate 1, 1', 2, 2' or the interior PCB 33, 33', 43, 43'.

Referring to FIGS. 13-32, twenty electrical connector systems made according to first to twentieth embodiments are respectively shown. The twenty embodiments are designed with similar structures to the first to fourth designs except that the transformer 600 and the common mode filter 800, 860, 880, 890 are differently designed.

In those twenty embodiments of the present invention, the electrical connector system provides two signal (communication) channels and accordingly has two transformers 600 and two common mode filters 800, 860, 880, 890. Each of the transformers 600 further has a magnetic core 610 defining two holes 601 parallel extending therethrough and forming a center wall 603 therebetween. The wires 61, 63 of the transformer 600 wind around the center wall 603 and through said two holes 601 in a same direction.

In the first to the fourth embodiments of the present invention (referring to FIGS. 13-16), the connector system has two separated common mode filters 800 corresponding to the two signal (communication) channels. Each of the two common mode filters 800 comprises a ringy magnetic core. The third wire 83 and the fourth wire 85 wind around said magnetic core to form a common mode module for filtering common noise in the signal (communication) channel. This type of common mode filter 800 has no container and conductive tail, and therefore the cost for making the same is comparatively low.

In the fifth to the eighth embodiments of the present invention (referring to FIGS. 17-20), the connector system has two common mode filters corresponding to the two signal (communication) channels. Those two common mode filters are incorporated into a plastic container 843 and form a common mode filter module 840. The plastic container 843 has a plurality of conductive tails 841 electrically connected to the opposite ends of the wires 83, 85 of the common mode filter. The common mode filter module 840 could be conveniently mounted onto corresponding PCB. The wires 83, 85 are electrically connected to conductive traces of the PCB through the conductive tails 841.

In the ninth to the twelfth embodiments of the present invention (referring to FIGS. 21-24), the connector system has two separated common mode filters 860 corresponding to the two signal (communication) channels. Each of the common mode filters 860 has a third and a fourth wires 83, 85 formed through printed circuit technology. The common mode filter 860 further comprises a plurality of conductive pads 861 respectively attached thereon and electrically connecting opposite ends of the third and the fourth wires 83, 85. The conductive pads 861 are preferred to mount the common mode filter 860 onto corresponding PCB through SMT (surface-mount technology). This type of common mode filter 860 can improve the function of filtering noise.

In the thirteenth to the sixteenth embodiments of the present invention (referring to FIGS. 25-28), the third wires 83 and the fourth wires 83 of the two common mode filters in the two signal (communication) channels wind around a common magnetic core 882 and thus form an integral common mode filter 880. It should be understood that if more signal (communication) channels were needed, more wires of the common mode filter of the signal (communication) channels could be wound around the magnetic core 882. The magnetic core 882 defines two holes 881 cutting there through. The third and the fourth wires 83, 85 wind around the magnetic core and get through the two holes 881. The third and the fourth wires 83, 85 have opposite ends directly mounted onto corresponding PCB. The benefit of these four embodiments is lower cost and smaller profile.

In the seventeenth to the twentieth embodiments of the present invention (referring to FIGS. 29-32), the connector system has two signal (communication) channels and accordingly two transformers and two common mode filters 890. Each of the common mode filter 890 comprises an "I" shaped magnetic core 892, a plurality of conductive pads 891 attached thereon, a third and a fourth wires 83, 85 winding around the magnetic core 892. The third and the fourth wires 83, 85 are electrically connected to the conductive pads 891. The "I" shaped magnetic core makes it easy to winding the third and the fourth wire 83, 85 around there. The conductive pads 891 are preferred to mount the common mode filter 890 onto corresponding PCB through SMT (surface-mount technology). This type of common mode filter 890 is the cheapest one in all the embodiments of present invention.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

We claim:

1. An electrical connector system used for a network interface, said network interface providing signal channel between a first side and a second side, said electrical connector system comprising:

a substrate forming a plurality of conductive traces;

an electrical connector mounted on the substrate;

a transformer having a first wire having two opposite ends electrically connected to said first side and a second wire having two opposite ends;

a common mode filter having a third wire and a fourth wire that are physically separated from the second wire;

wherein the third wire has an end electrically connected to one end of the second wire and an opposite end electrically connected to said second side, and wherein the fourth wire has an end electrically connected to the opposite end of the second wire and an opposite end electrically connected to said second side, thereby a signal channel is formed between the first side and the second side;

the transformer further having a magnetic core defining two holes parallel extending therethrough and forming a center wall between the two holes, the wires of the transformer winding around the center wall and through said two holes;

wherein the common mode filter further comprises a ringy magnetic core, the third wire and the fourth wire winding around said magnetic core to form a common mode module for filtering common noise in the signal channel.

2. An electrical connector system according to claim 1, wherein the electrical connector further comprises an interior PCB, the interior PCB forming a plurality of conductive traces, the transformer and the common mode module being mounted on the interior PCB, the opposite ends of the second wire being respectively and electrically connected to the ends of the third and the fourth wires through some of the conductive traces of the interior PCB.

3. An electrical connector system according to claim 2 wherein the interior PCB forms a plurality of conductive pads electrically connecting corresponding conductive traces, and the opposite ends of the wires are directly soldered onto the conductive pads of the interior PCB.

4. An electrical connector system according to claim 1, wherein the transformer and the common mode module are mounted on the substrate, the ends of the second wire being respectively and electrically connected to the ends of the third and the fourth wires through some of the conductive traces of the substrate.

5. An electrical connector system according to claim 1, wherein said electrical connector further comprises an interior PCB mounted inside the electrical connector, a plurality of mating contacts mounted on the interior PCB for mating with a complimentary connector and a plurality of transferring contacts connecting the interior PCB to the substrate, said transformer being mounted on the interior PCB and said common mode module being mounted on the substrate.

6. An electrical connector system according to claim 1, wherein said electrical connector further comprises an interior PCB mounted inside the electrical connector, a plurality of mating contacts mounted on the interior PCB for mating with a complimentary connector and a plurality of transferring contacts connecting the interior PCB to the substrate, said common mode module being mounted on the interior PCB and said transformer being mounted on the substrate.

7. An electrical connector system according to claim 1, wherein the common mode filter is incorporated into a plastic container, and the plastic container is configured with a plurality of conductive tails electrically connected to the opposite ends of the third and the fourth wires.

8. An electrical connector system according to claim 7, wherein there are two signal channels, the filter of the two signal channels being incorporated into the same plastic container.

9. An electrical connector system according to claim 1, wherein there are two signal channels, the common mode filter further having a magnetic core defining two holes parallel extending therethrough and forming a center wall between the two holes, the wires of the common mode filters of the two signal channels winding around the center wall and through said two holes in a same direction.

10. An electrical connector system according to claim 1, wherein the third and the fourth wires of the common mode filter are manufactured through printed circuit technology.

11. An electrical connector system according to claim 10, wherein the common mode filter comprises a plurality of conductive pads electrically connected to the opposite ends of the wires of the common mode filter.

12. An electrical connector system according to claim 1, wherein the common mode filter further comprises an "I" shaped magnetic core, a plurality of conductive pads attached thereon, the third and the fourth wires winding around the magnetic core and having opposite ends electrically connected to corresponding conductive pads.

* * * * *